US011796937B2

(12) United States Patent
Shimizu

(10) Patent No.: US 11,796,937 B2
(45) Date of Patent: Oct. 24, 2023

(54) IMAGE FORMING APPARATUS WITH REPLENISHABLE TONER SUPPLY

(71) Applicant: CANON KABUSHIKI KAISHA, Tokyo (JP)

(72) Inventor: Kazumichi Shimizu, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/682,274

(22) Filed: Feb. 28, 2022

(65) Prior Publication Data

US 2022/0283525 A1 Sep. 8, 2022

(30) Foreign Application Priority Data

Mar. 5, 2021 (JP) ..... 2021-035218

(51) Int. Cl.
*G03G 15/08* (2006.01)
*G03G 21/18* (2006.01)

(52) U.S. Cl.
CPC ..... *G03G 15/0889* (2013.01); *G03G 15/0856* (2013.01); *G03G 15/0862* (2013.01); *G03G 15/0863* (2013.01); *G03G 15/0868* (2013.01); *G03G 15/0877* (2013.01); *G03G 15/0879* (2013.01); *G03G 15/0891* (2013.01); *G03G 21/1878* (2013.01)

(58) Field of Classification Search
CPC ..... G03G 15/0889; G03G 15/0856; G03G 15/0863; G03G 15/0868; G03G 15/0891; G03G 15/0877; G03G 15/0879; G03G 15/0862; G03G 15/5012; G03G 15/70; G03G 15/6558; G03G 15/657; G03G 21/1889; G03G 21/1878; G03G 21/1857; G03G 2215/0692; G03G 2221/1675
See application file for complete search history.

(56) References Cited

U.S. PATENT DOCUMENTS 5,970,280 A * 10/1999 Suzuki ..... G03G 15/065 399/285
2005/0129420 A1* 6/2005 Mimura ..... G03G 15/0849 399/27
2018/0270381 A1* 9/2018 Ikuta ..... H04N 1/00896
2018/0321614 A1* 11/2018 Hayashi ..... G03G 15/0877

FOREIGN PATENT DOCUMENTS

JP 08-30084 A 2/1996

* cited by examiner

*Primary Examiner* — Arlene Heredia
*Assistant Examiner* — Laura Roth
(74) *Attorney, Agent, or Firm* — Venable LLP

(57) ABSTRACT

An image forming apparatus includes an image bearing member, a replenishment unit, an agitation member, a drive source, a control unit, a memory unit, and a remaining amount detection unit. The control unit performs (1) a first operation to drive the drive source for a first time in a case where it is judged based on the output value of the remaining amount detection unit that the toner has increased, and (2) a second operation to drive the drive source for a second time that is shorter than the first time in a case where it is judged based on the output value of the remaining amount detection unit that the toner has not increased.

13 Claims, 17 Drawing Sheets

IMAGE FORMING APPARATUS WITH REPLENISHABLE TONER SUPPLY

BACKGROUND OF THE INVENTION

Field of the Invention

This disclosure relates to an image forming apparatus that forms an image on a sheet.

Description of the Related Art

Generally, an image forming apparatus of an electrophotographic system forms an image by transferring a toner image formed on a surface of a photosensitive drum to a sheet which serves as a transcription material. As a replenishing type of toner (developer) for forming the toner image, for example, a process cartridge type and a toner replenishing type are known. The process cartridge type is a type in which the photosensitive drum and a developer container are integrated as a process cartridge and the process cartridge is replaced with a new cartridge when the toner has been fully consumed. The toner replenishing type is a type in which, when the toner has been fully consumed, only the toner is replenished to the developer container not replacing the process cartridge itself.

Hitherto, a one-component developing device of the toner replenishing type in which a toner feed container storing the toner for replenishment is coupled to a toner conveyance path through which the toner is conveyed is suggested (refer to Japanese Patent Laid-Open No. H08-30084). The toner for the replenishment stored in the toner feed container is conveyed to a developing roller by an agitation conveyance member.

In a case where lengthy agitation time is secured for the agitation conveyance member, downtime of the image forming apparatus is extended, and, also, a life of a developing device becomes short.

SUMMARY OF THE INVENTION

According to a first aspect of the present invention, an image forming apparatus includes an image bearing member configured to bear a toner image, a storage portion configured to store toner, a replenishment unit to which a replenishment container storing the toner is detachably attached, the replenishment unit being configured to transition between a replenishable state and a replenishing disabled state, the replenishable state being a state where it is possible to replenish the toner from the replenishment container to the storage portion, the replenishing disabled state being a state where it is not possible to replenish the toner from the replenishment container to the storage portion, an agitation member configured to agitate the toner in the storage portion, a drive source configured to drive the agitation member, a control unit configured to drive the drive source so as to drive the agitation member based on a transition of the replenishment unit to the replenishable state in a state where a drive of the drive source is allowed, a memory unit configured to store information on a transition of the replenishment unit to the replenishable state in a state where the drive of the drive source is not allowed, and a remaining amount detection unit configured to change an output value based on an amount of the toner in the storage portion. In a case where an initial control for bringing the image forming apparatus to a state capable of image formation is performed in a state where the information is stored in the memory unit, the control unit performs (1) a first operation to drive the drive source for a first time in a case where it is judged based on the output value of the remaining amount detection unit that the toner has increased, and (2) a second operation to drive the drive source for a second time that is shorter than the first time in a case where it is judged based on the output value of the remaining amount detection unit that the toner has not increased.

According to a second aspect of the present invention, an image forming apparatus includes an image bearing member configured to bear a toner image, a storage portion configured to store toner, a replenishment unit to which a replenishment container storing the toner is detachably attached, the replenishment unit being configured to replenish the toner from the replenishment container to the storage portion, an agitation member configured to agitate the toner in the storage portion, a drive source configured to drive the agitation member, a control unit configured to control the drive source, and a remaining amount detection unit configured to change an output value based on an amount of the toner in the storage portion. The control unit is configured to perform a first mode and a second mode at a time of performing an initial control which is configured to be performed when an electric power source is supplied to the image forming apparatus, the first mode being a mode in which the drive source is configured to be driven so as to drive the agitation member for a first time, the second mode being a mode in which the drive source is configured to be driven so as to drive the agitation member for a second time that is shorter than the first time.

Further features of the present invention will become apparent from the following description of exemplary embodiments with reference to the attached drawings.

DESCRIPTION OF THE EMBODIMENTS

Hereinafter, embodiments for executing this disclosure will be described with reference to drawings.

First Embodiment

Figure 1:
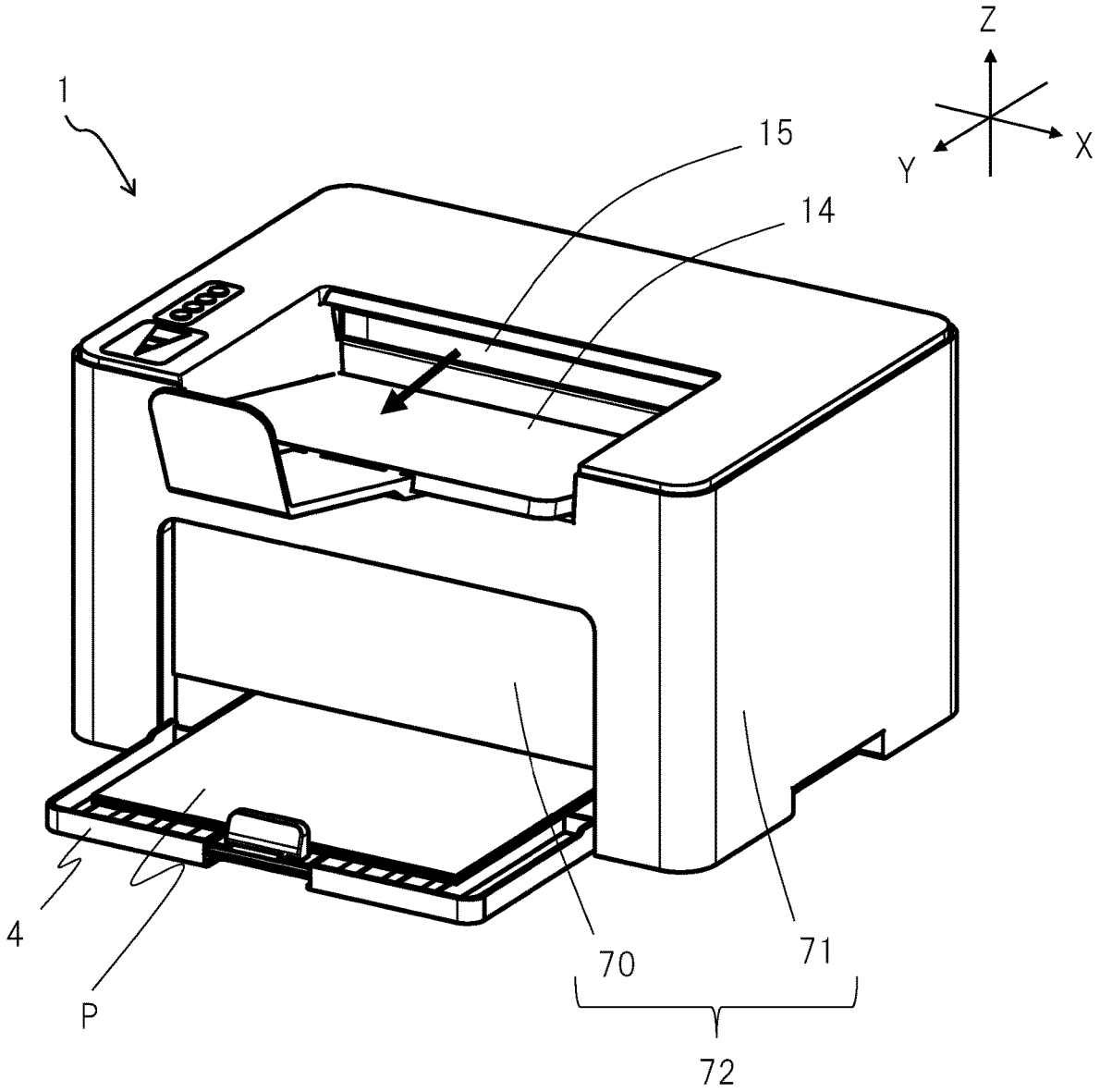
FIG. 1 is a perspective view showing an image forming apparatus according to a first embodiment.
Figure 2:
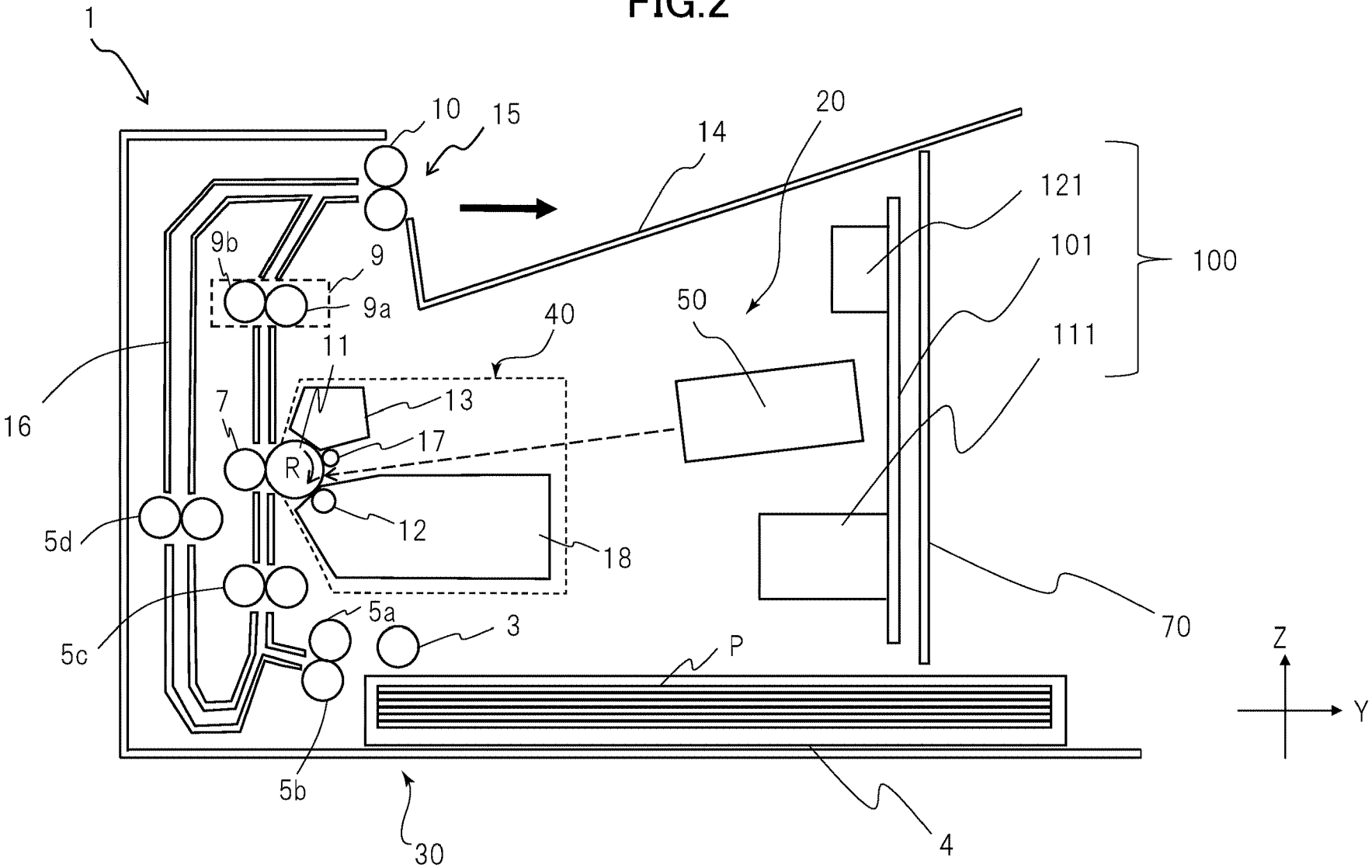
FIG. 2 is a diagram showing a general arrangement of the image forming apparatus.

FIG. 1 is a perspective view showing an image forming apparatus 1 according to a first embodiment. FIG. 2 is a schematic view showing a configuration of the image forming apparatus 1. The image forming apparatus 1 is a monochromatic printer which forms an image on a recording material based on image information input from an external apparatus. The recording material includes various kinds of sheet materials different in a material including paper such as a standard paper and cardboard, plastic film such as a sheet for an overhead projector, a specially shaped sheet such as an envelope and an index sheet, and cloth.

Further, in the following description, a height direction of the image forming apparatus 1 (opposite direction of the vertical direction) in a case where the image forming apparatus 1 is installed on a horizontal surface is referred to as a Z direction. A direction intersecting with the Z direction and parallel to a rotational axis of a photosensitive drum 11, described later, is referred to as an X direction. A direction intersecting with the X direction and the Z direction is referred to as a Y direction. Preferably, the X, Y, and Z directions perpendicularly intersect with each other. Further, for convenience, a plus side and a minus side in the X direction are respectively referred to as a right side and a left side, a plus side and a minus side in the Y direction are respectively referred to as a forward or front side and a back or rear plane side, and a plus side and a minus side in the Z direction are respectively referred to as an upper side and a lower side.

General Arrangement

The image forming apparatus 1 includes, as shown in FIGS. 1 and 2, an image forming unit 20 forming the image on the recording material, a feeding unit 30 feeding the recording material P, a fixing unit 9 fixing the toner image formed by the image forming unit 20 onto the recording material, and a discharge roller pair 10.

The image forming unit 20 includes a scanner unit 50, a process unit 40 of an electrophotographic system, and a transfer roller 7 for transferring the toner image formed on the photosensitive drum 11 of the process unit 40 to the recording material P. The process unit 40 includes the photosensitive drum 11, a cleaning unit 13 disposed around the photosensitive drum 11, a charge roller 17, a developing roller 12, and a storage portion 18 for storing the toner. To be noted, it is acceptable that the process unit 40 is fastened to a casing 72 of the image forming apparatus 1 with a screw, and the process unit 40 includes a unit which is detached by a serviceman.

The photosensitive drum 11, serving as an image bearing member, is a cylindrically formed photoreceptor. The photosensitive drum 11 of this embodiment includes a photosensitive layer formed of an organic photoreceptor of a negative charge type on a drum shaped substrate made of aluminum. Further, the photosensitive drum 11, serving as the image bearing member, is rotatably driven in a predetermined direction (arrow R direction in FIG. 2) at a predetermined process speed by a motor.

The charge roller 17 comes into contact with the photosensitive drum 11 under a predetermined pressing force, and forms a charge portion. Further, by applying a desired charge voltage from a charging high-voltage power source, the charge roller 17 brings a surface of the photosensitive drum 11 to a predetermined electric potential uniformly. In this embodiment, the photosensitive drum 11 is charged by the charge roller 17 in a negative polarity.

The scanner unit 50 scans and exposes the surface of the photosensitive drum 11 by irradiating the photosensitive drum 11 with a laser beam corresponding to the image information input from the external apparatus using a polygon mirror. With this exposure, an electrostatic latent image corresponding to the image information is formed on the surface of the photosensitive drum 11. To be noted, the scanner unit 50 is not limited to a laser scanner apparatus, and, for example, it is acceptable to adopt an LED (light-emitting diode) exposure apparatus including an LED array in which a plurality of LEDs are arrayed along a longitudinal direction of the photosensitive drum 11.

The developing roller 12 is rotatably supported by the storage portion 18. Further, the developing roller 12 is disposed at an opening of a developer container 230 including the storage portion 18 (refer to FIG. 5) so as to face the photosensitive drum 11. To be noted, in the storage portion 18, it is acceptable to dispose a supply roller for coating a surface of the developing roller 12 with the toner, serving as developer, stored in the storage portion 18.

The process unit 40 of this embodiment uses a contact developing system as a developing system. That is, a toner layer borne by the developing roller 12 touches the photosensitive drum 11 at a developing portion (developing area) where the photosensitive drum 11 and the developing roller 12 face each other. A developing voltage is applied to the developing roller 12 by a developing high-voltage power source. As the toner borne on the developing roller 12 is transferred to the surface of the photosensitive drum 11 in accordance with an electric potential distribution on the drum surface under the developing voltage, the electrostatic latent image is developed into the toner image.

Further, the toner of this embodiment is so-called non-magnetic one-component developer not containing a magnetic component and bearing the toner on the developing roller 12 mainly by an intermolecular force and an electrostatic force (image-force). However, it is acceptable to use the one-component developer containing a magnetic component. Further, in some cases, additives (for example, fine particles of wax or silica) other than toner particles for adjusting fluidity or charging property of the toner are contained in the one-component developer. Further, as the developer, it is acceptable to use the two-component developer including a non-magnetic toner and a carrier having a magnetic property. In a case where the toner having the magnetic property is used, a cylindrically shaped sleeve in which a magnet is disposed inside is used as a developer bearing member.

The fixing unit 9 is a heat fixation type which performs a fixing process of the image by heating to melt the toner on the recording material. The fixing unit 9 includes a heating roller 9*a* incorporating a fixing heater 9*c*, and a press roller 9*b* coming into pressure contact with the heating roller 9*a*.

The feeding unit 30 includes a cassette 4 stacking the recording material P, and a pick-up roller 3, a feed roller 5*a*, and a separation roller 5*b*, serving as a conveyance unit. A front cover 70 is disposed on a part of an end face on the front side of the image forming apparatus 1, and the front cover 70 covers a circuit substrate 100. The casing 72 includes the front cover 70, a discharge tray 14, and an exterior cover 71 constructing an exterior of the image forming apparatus 1 with the front cover 70 and the discharge tray 14. A discharge port 15 through which the sheet discharged to the discharge tray 14 is formed in the casing 72.

As shown in FIG. 2, the image forming apparatus 1 includes the circuit substrate 100. The circuit substrate 100 includes a circuit plate 101 made of insulating material, and electronic components 111 and 121 soldered to the circuit plate 101. As the wiring made of an electric conductor is disposed on and inside the circuit substrate 100, the electronic components 111 and 121 are coupled to each other. The circuit substrate 100 provides functions for converting an alternating current supplied from the outside of the image forming apparatus 1 into a direct current, and converting an input voltage so as to obtain a predetermined voltage value required for an image forming process.

The circuit substrate 100 is disposed in a direction in which a face of the circuit plate 101, on which the electronic components 111 and 121 are mounted, intersects with a discharge direction. Further, the circuit plate 101 is disposed between the front cover 70 and the scanner unit 50 in the discharge direction. The electronic components 111 and 121 are, on the circuit plate 101, disposed on a side of a face facing the scanner unit 50.

Next, an image forming operation of the image forming apparatus 1 will be described. When an instruction for image formation is input to the image forming apparatus 1, the image forming unit 20 starts the image forming process based on the image information input from an external computer coupled to the image forming apparatus 1. The scanner unit 50 irradiates the photosensitive drum 11 with the laser beam based on the input image information. At this time, the photosensitive drum 11 has been charged by the charge roller 17 beforehand, and, by irradiation with the laser beam, the electrostatic latent image is formed on the photosensitive drum 11. Thereafter, this electrostatic latent image is developed by the developing roller 12, and the toner image is formed on the photosensitive drum 11.

In parallel with the image forming process described above, the pick-up roller 3 of the feeding unit 30 picks up the recording material P supported by the cassette 4. The recording material P is separated into one sheet at a time by the feed roller 5*a* and the separation roller 5*b*, and conveyed by a conveyance roller pair 5*c*. Then, the recording material P is conveyed by the conveyance roller pair 5*c* to a transfer nip formed by the transfer roller 7 and the photosensitive drum 11.

A transfer voltage is applied to the transfer roller 7 from a transferring high-voltage power source, and the toner image borne on the photosensitive drum 11 is transferred to the recording material P conveyed by the conveyance roller pair 5*c*. The recording material P on which the toner image has been transferred is conveyed to the fixing unit 9, and the toner image is heated and pressed at a time of passing through a nip portion between the heating roller 9*a* and the press roller 9*b* of the fixing unit 9. Thereby, toner particles are melted and thereafter adhered, so that the toner image is fixed onto the recording material P. The recording material P passed through the fixing unit 9 is discharged to the outside (outboard) of the image forming apparatus 1 from the discharge port 15 by the discharge roller pair 10.

In a case of forming the image on both surfaces of the recording material P, the discharge roller pair 10 guides the recording material P to a duplex conveyance path 16 by switchbacking the recording material P on which the image has been formed on a first surface. The recording material P guided to the duplex conveyance path 16 is conveyed toward the transfer roller 7 again by a duplex conveyance roller pair 5*d*. After the image has been formed on a second surface by the transfer roller 7, the recording material P is discharged outside the apparatus. Further, the toner remained on the photosensitive drum 11 after the toner image has been transferred to the recording material P is collected by the cleaning unit 13.

Replenishment Unit

Figure 3A:
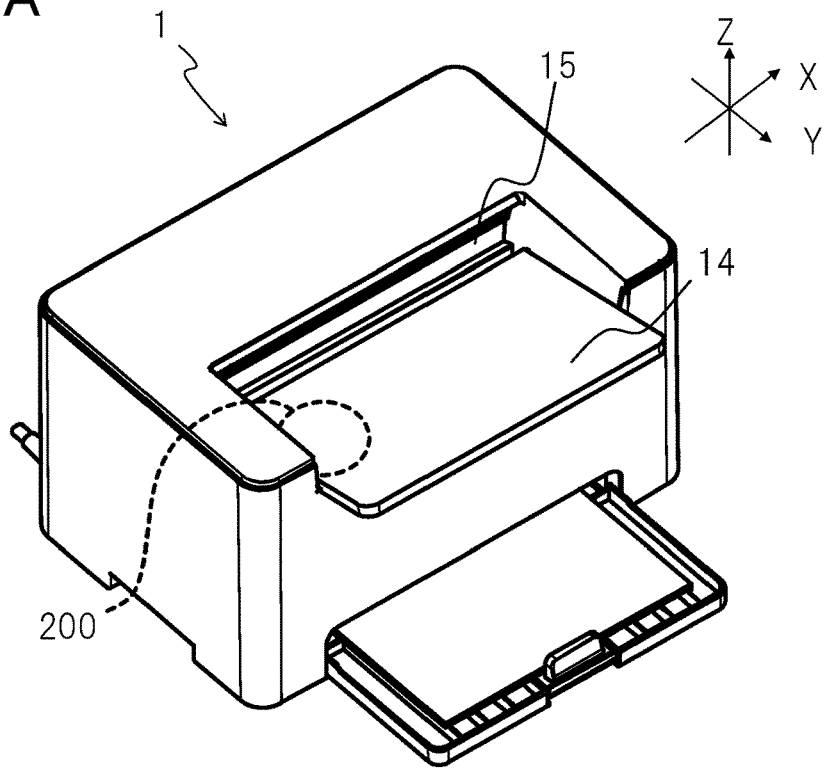
FIG. 3A is a perspective view showing the image forming apparatus in a state where a discharge tray is located in a closed position.
Figure 3B:
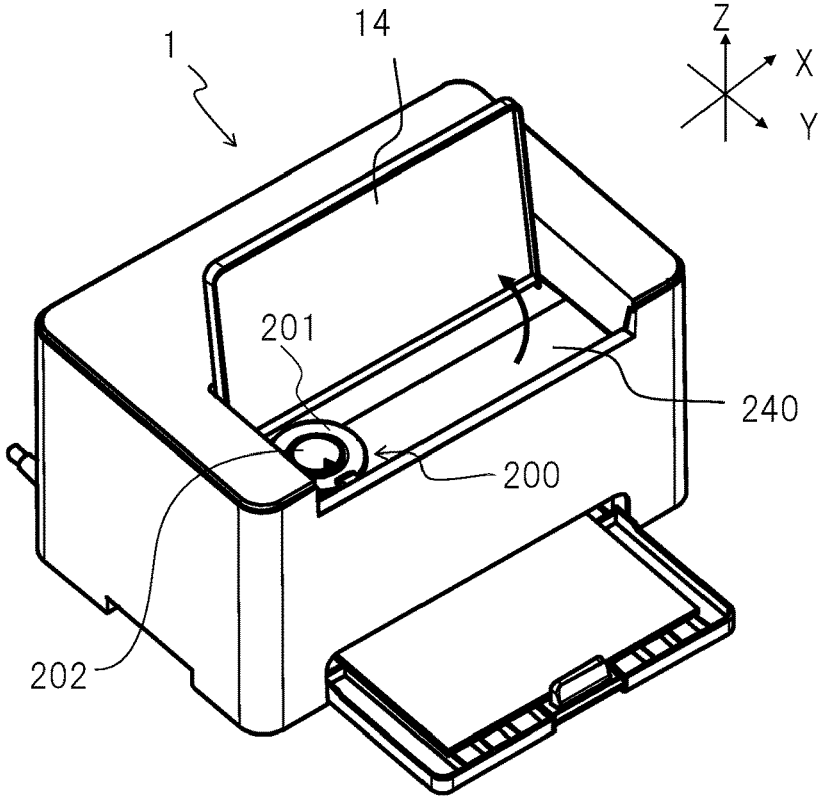
FIG. 3B is a perspective view showing the image forming apparatus in a state where the discharge tray is located in an opening position.

Next, using FIGS. 3A to 7, a replenishment unit 200 will be described. The discharge tray 14 is supported in an openable manner so that the discharge tray 14 is capable of changing a position between a closed position, where the discharge tray 14 is capable of stacking the recording material P as shown in FIG. 3A, and an opening position, where the discharge tray 14 is opened as shown in FIG. 3B. The discharge tray 14 covers the replenishment unit 200 in the closed position. When the discharge tray 14 is opened to the opening position, a top surface 240 and the replenishment unit 200 disposed adjacent to the top surface 240 are exposed. A replenishment pack 210, described later, is detachable from the replenishment unit 200, and a user or the serviceman is able to replenish the toner without removing the developer container 230 from the casing 72.

Figure 4:
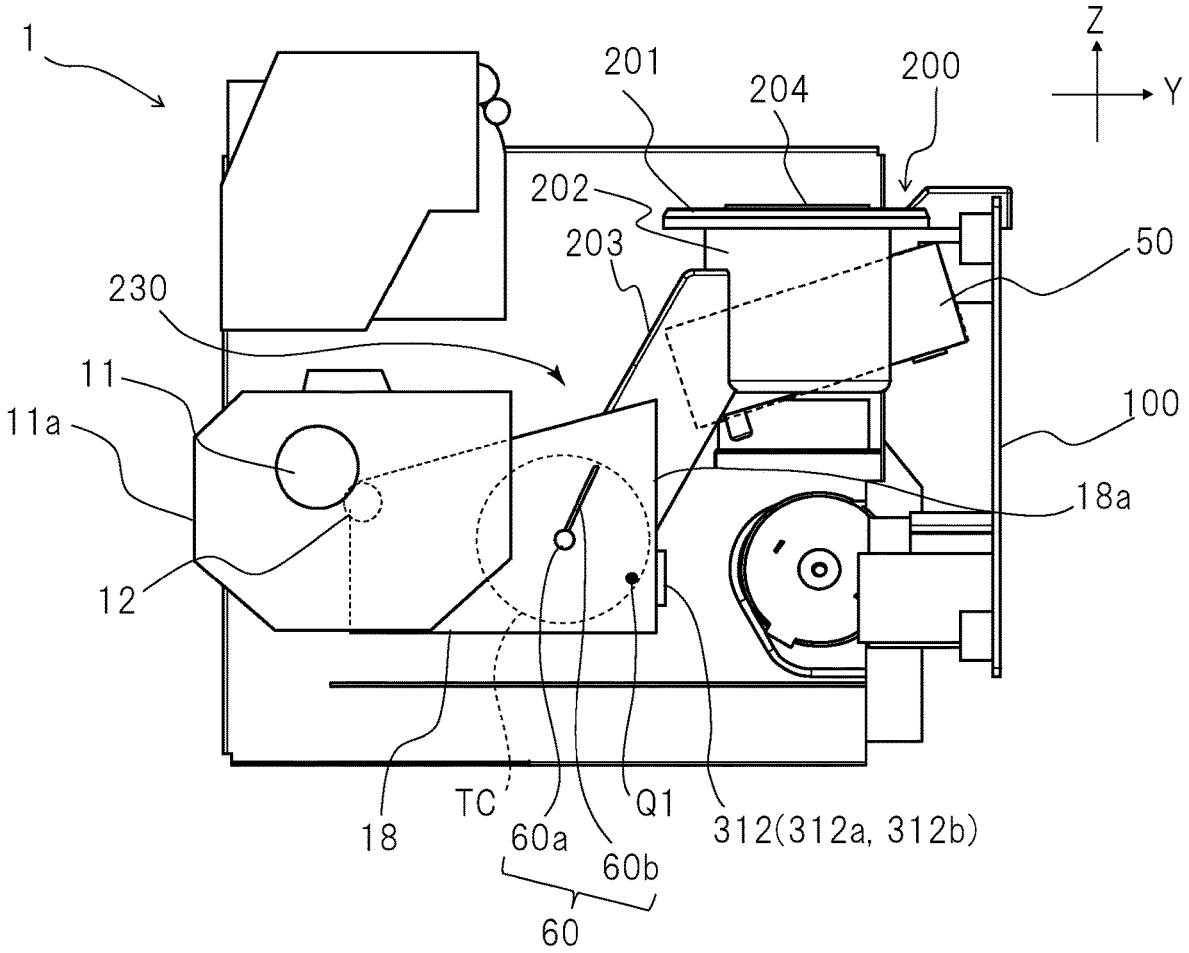
FIG. 4 is a side view showing the image forming apparatus.
Figure 5:
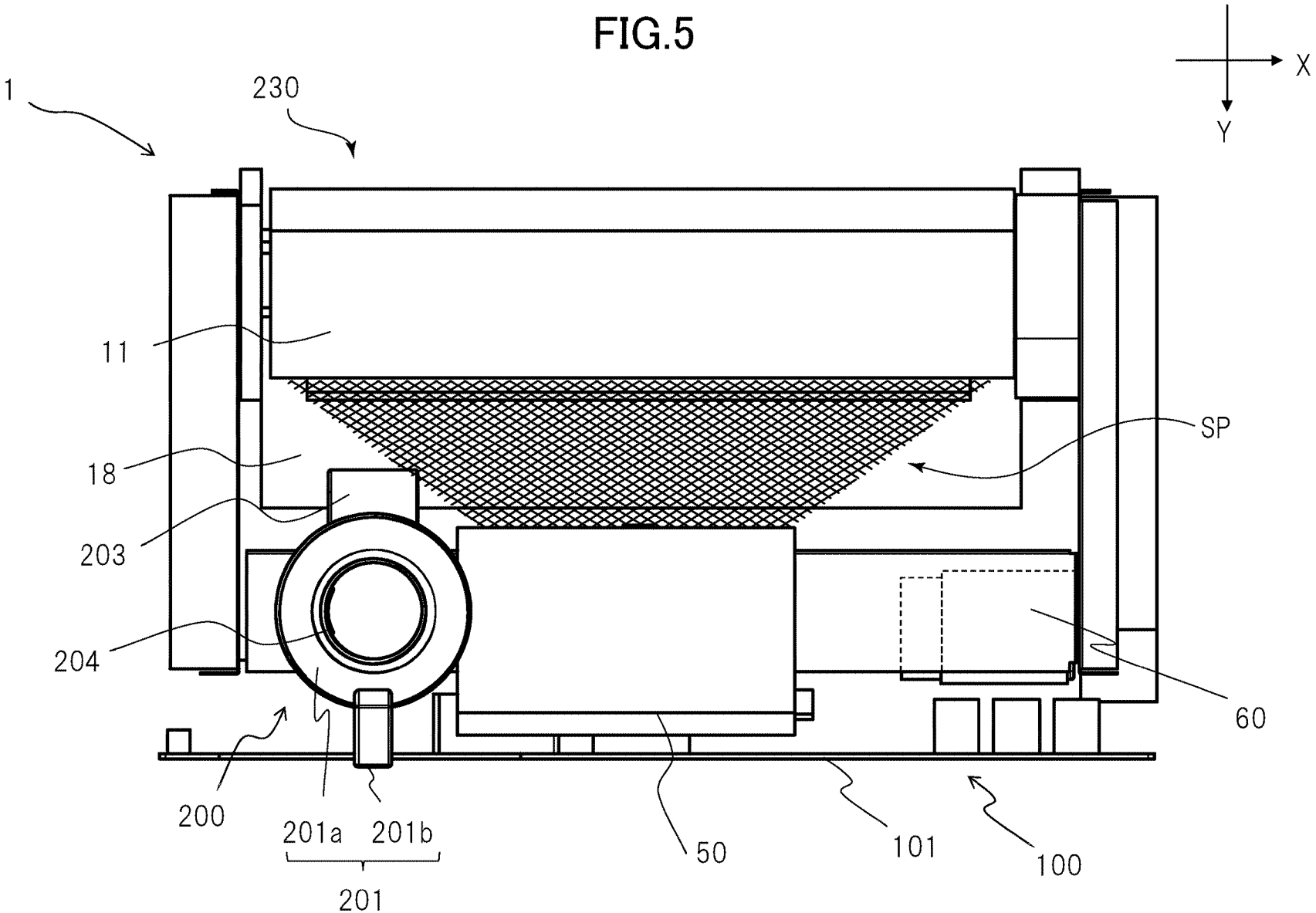
FIG. 5 is a plan view showing the image forming apparatus.
Figure 6:
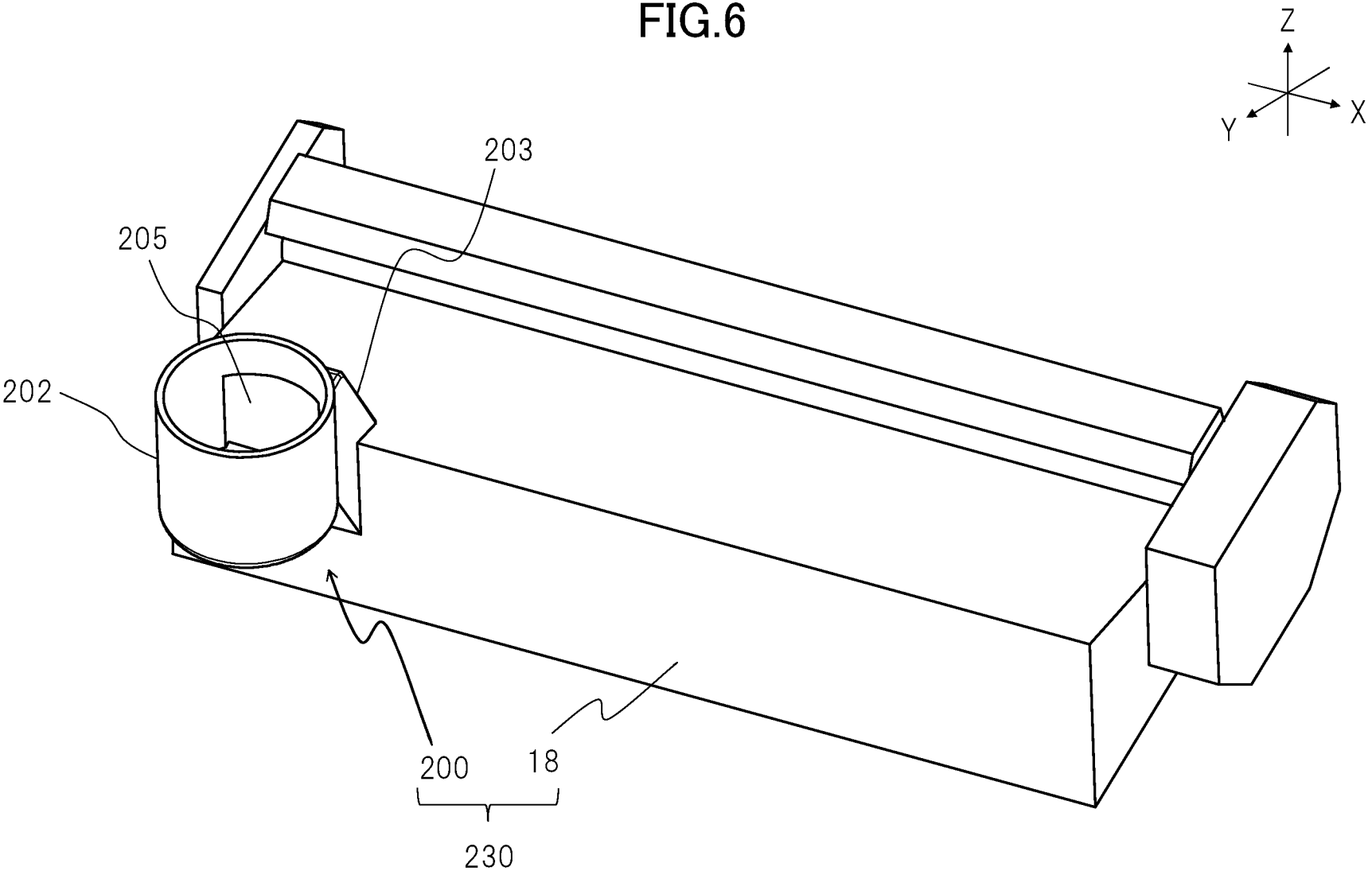
FIG. 6 is a perspective view showing a developer container.

FIGS. 4 and 5 respectively show side and plan views of the image forming apparatus 1 in a state where the casing 72 is removed. FIG. 6 is a perspective view showing the developer container 230. To be noted, a lever portion 201 and some members accompanying the lever portion 201 are omitted in FIG. 6.

As shown in FIGS. 4 to 6, the developer container 230 is constructed by the storage portion 18 and the replenishment unit 200. The replenishment unit 200 includes the lever portion 201, a cylindrically shaped toner receiving portion 202, a replenishment path portion 203 coupling the toner receiving portion 202 and the storage portion 18 to each other, and a body shutter member 206 (refer to FIG. 7A).

A side surface opening 205 communicating with the replenishment path portion 203 is formed in an inner wall of the toner receiving portion 202. The replenishment pack 210 is attached to the lever portion 201, and the toner discharged from the replenishment pack 210 is replenished to the storage portion 18 through the lever portion 201, an opening 207 of the body shutter member 206, a side surface opening 205 of the toner receiving portion 202, and the replenishment path portion 203.

The replenishment path portion 203 is coupled to a side of one end of the storage portion 18 in a longitudinal direction, that is, the X direction of the developer container 230. As shown in FIG. 4, an agitation member 60 rotating around a rotational shaft 60*a*, which extends in the X direction, as the center is disposed in the storage portion 18. The agitation member 60 includes a blade portion 60*b* fixed to the rotational shaft 60*a*, and is rotatably driven by a motor 311 (refer to FIG. 12). Thereby, the agitation member 60 agitates the toner in the storage portion 18, and conveys the toner toward the developing roller 12. To be noted, while, in this embodiment, the agitation member 60 is constructed by the rotational shaft 60*a* and the blade portion 60*b*, it is acceptable to use a spirally shaped agitation member so as to distribute the toner over the entire length of the storage portion 18.

Further, the agitation member 60 operates for uniformizing the toner in the storage portion 18 by circulating the toner not used for development and peeled from the developing roller 12. To be noted, the agitation member 60 is not limited to a rotating form. For instance, it is acceptable to use a swinging form for the agitation member. Further, it is acceptable to dispose yet another agitation member in addition to the agitation member 60.

Further, a remaining amount detection unit 312 detecting an amount of the toner in the storage portion 18 is disposed on a side surface opposite the developing roller 12, and the remaining amount detection unit 312 includes a light emitting portion 312*a* and a light receiving portion 312*b*. The light emitting portion 312*a* and the light receiving portion 312*b* are disposed alongside in the X direction. Light emitted from the light emitting portion 312*a* passes through the inside of the storage portion 18, and is received by the light receiving portion 312*b*. That is, the light emitting portion 312*a* and the light receiving portion 312*b* form an optical path Q1 in the storage portion 18. The optical path Q1 extends in the X direction. To be noted, it is acceptable that the light emitting portion 312*a* and the light receiving portion 312*b* respectively dispose a light emitting element and a light receiving element either inside or outside the storage portion 18. In a case where the light emitting element and the light receiving element are disposed outside the storage portion 18, the light is guided from the outside to the inside of the storage portion 18 through a light guide portion.

Further, the light emitting portion 312*a* and the light receiving portion 312*b* are disposed in the center area of the storage portion 18 in the X direction. In particular, the light emitting portion 312*a* and the light receiving portion 312*b* are disposed within an area corresponding to a laser passing space SP in the X direction. By disposing the light emitting portion 312*a* and the light receiving portion 312*b* in the center of the storage portion 18 as described above, it is possible to detect a remaining amount of the toner in the storage portion 18 well. That is, while the developer (toner) sometimes exists unevenly at the edge of the storage portion 18 in the X direction, since the uneven distribution of the developer is little in the center area of the storage portion 18, it is possible to detect a realistic amount of the remaining toner.

To be noted, while, in this embodiment, the LED and a phototransistor, which turns into an ON state by the light from the LED, are respectively used for the light emitting portion 312*a* and the light receiving portion 312*b*, it is not limited to this. For instance, it is acceptable to apply a halogen or fluorescent lamp to the light emitting portion 312*a*, and apply a photodiode or an avalanche photodiode to the light receiving portion 312*b*.

The light receiving portion 312*b* that is the phototransistor receives the light emitted from the light emitting portion 312*a*, and outputs a signal (electric current) corresponding to an amount of a received light. This signal is converted into a voltage, and input to a control unit 302 (refer to FIG. 12). That is, the light receiving portion 312*b* changes an output value based on the amount of the toner (developer) stored in the storage portion 18.

Based on an input voltage level, the control unit 302 judges whether or not the light receiving portion 312*b* has received the light from the light emitting portion 312*a*. The control unit 302 calculates the amount of the toner (amount of developer) in the storage portion 18 based on the duration of the time during which the light receiving portion 312*b* detects the light at a time when the agitation member 60 has agitated the toner in the storage portion 18 for a predetermined time. That is, a ROM (read-only memory) 302*a* of the control unit 302 stores beforehand a table which is capable of outputting the remaining amount of the toner based on the duration of the light receiving time at the time when the toner has been agitated by the agitation member 60, and the control unit 302 estimates and calculates the remaining amount of the toner based on this table.

In particular, as shown in FIG. 4, the optical path Q1 of the remaining amount detection unit 312 is set so as to overlap a rotation trajectory TC of the agitation member 60, when viewed in a shaft direction of a rotational axis of the agitation member 60. In other words, the light emitted from the light emitting portion 312*a* of the remaining amount detection unit 312 passes through the inside of the storage portion 18 and within the rotation trajectory TC of the agitation member 60 when viewed in the shaft direction of the agitation member 60. Then, the time during which the optical path Q1 is blocked by the toner conveyed by the agitation member 60 during one revolution of the agitation member 60, that is, the time during which the light receiving portion 312*b* does not detect the light from the light emitting portion 312*a* changes depending on the remaining amount of the toner.

That is, since the optical path Q1 is easily blocked by the toner when the remaining amount of the toner is large, the duration of the light receiving time of the light receiving portion 312*b* becomes short. On the other hand, when the remaining amount of the toner is small, the duration of the light receiving time of the light receiving portion 312*b* becomes conversely long. Therefore, the control unit 302 is capable of judging a level of the remaining amount of the toner in the storage portion 18 based on the duration of the light receiving time of the light receiving portion 312*b* as described above.

To be noted, a method for detection/estimation of the remaining amount of the toner is not limited to the method described above, and it is possible to apply various well-known types of the method to the detection/estimation of the remaining amount of the toner. For instance, it is acceptable to detect and estimate the remaining amount of the toner by disposing at least two metal plates or at least two sheets of an electroconductive resin, which extend in a longitudinal direction of the developing roller, on the inner wall of the storage portion 18. In such a case, the remaining amount of the toner is detected and estimated by measuring electrical capacitance between two of the metal plates or two of the electroconductive resin sheets. Alternatively, it is acceptable to dispose a load cell in a member supporting the developer container 230 from below, and calculate the remaining amount of the toner based on the weight measured by the load cell.

The lever portion 201 is disposed on the top surface 240, and forms a replenishment port 204, serving as an opening for replenishing the toner. In the X direction, the width of the replenishment port 204 is narrower than the width of the storage portion 18. Further, the lever portion 201 is disposed in a form surrounding the replenishment port 204, and includes a ring portion 201*a* rotatably supported by the top surface 240 or the toner receiving portion 202, and a holding portion 201*b* integrally disposed with the ring portion 201*a*.

Figure 7A:
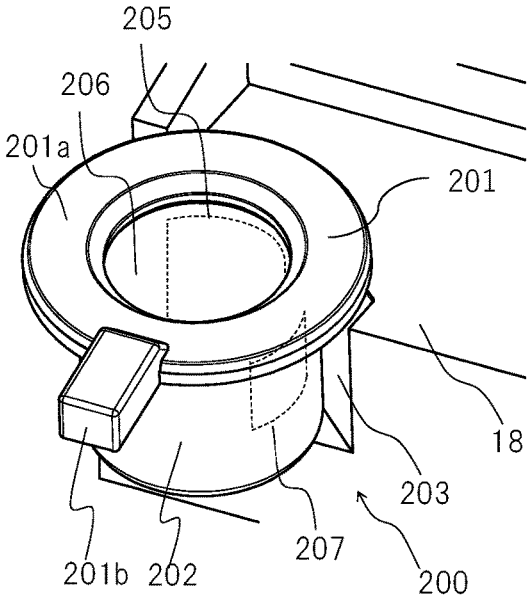
FIG. 7A is a perspective view showing a replenishment unit in a state where a lever portion is located in an operating position.

As shown in FIG. 7A, the body shutter member 206 is a cylindrically shaped member concentric with the toner receiving portion 202, and rotatably disposed in the toner receiving portion 202. The body shutter member 206 includes the opening 207, and the opening 207 and the side surface opening 205 of the toner receiving portion 202 are out of alignment in a closed position shown in FIG. 7A. Therefore, the side surface opening 205 is shielded by the body shutter member 206, and the toner is not discharged to the replenishment path portion 203.

Figure 7B:
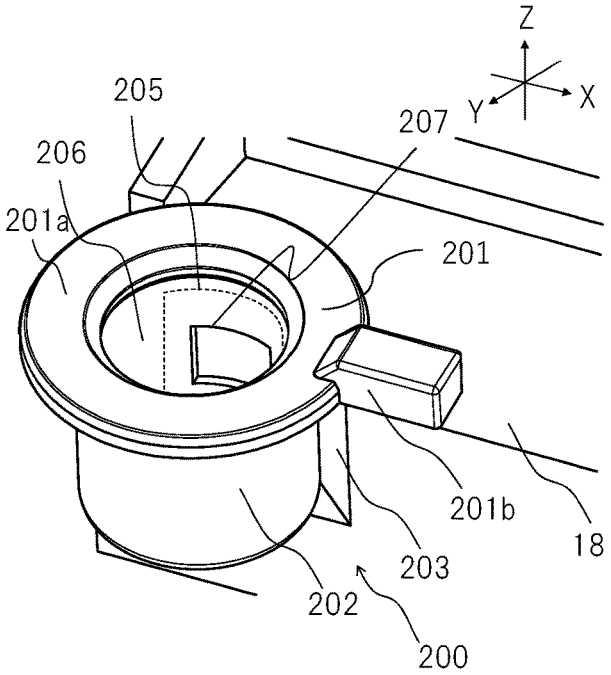
FIG. 7B is a perspective view showing the replenishment unit in a state where the lever portion is located in a replenishing position.

Further, when the body shutter member 206 is located in an opening position shown in FIG. 7B, the opening 207 overlaps the side surface opening 205 of the toner receiving portion 202. Therefore, it is possible to discharge the toner replenished from the replenishment pack 210 (refer to FIG. 10A) attached to the replenishment unit 200 to the replenishment path portion 203 through the side surface opening 205 and the opening 207.

While details will be described later, the body shutter member 206 moves between the closed position and the opening position by rotating the lever portion 201 in a state where the replenishment pack 210 is attached to the replenishment unit 200. That is, when the user rotates the holding portion 201*b* of the lever portion 201 by 90° in a counterclockwise direction from the closed position shown in FIG. 7A, the body shutter member 206 moves to the opening position shown in FIG. 7B.

When the image is formed on the recording material P, it is necessary to shut off the side surface opening 205 by the body shutter member 206 so as not to leak the toner, which is agitated in the storage portion 18 by the agitation member 60 (refer to FIG. 4), from the side surface opening 205. Therefore, at the time of the image formation, the lever portion 201 is located in an operating position shown in FIG. 7A so as to locate the body shutter member 206 in the closed position. On the other hand, at the time of replenishing the toner to the storage portion 18 from the replenishment pack 210, it is necessary to open the side surface opening 205. Therefore, at the time of replenishing the toner, the lever portion 201 is located in a replenishing position shown in FIG. 7B so as to locate the body shutter member 206 in the opening position.

Figure 7C:
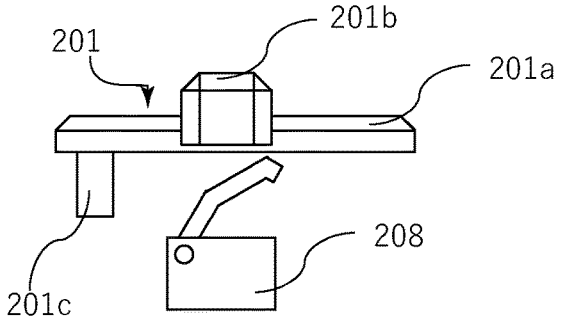
FIG. 7C is a side view showing the lever portion and a switch which are located in the operating position.
Figure 7D:
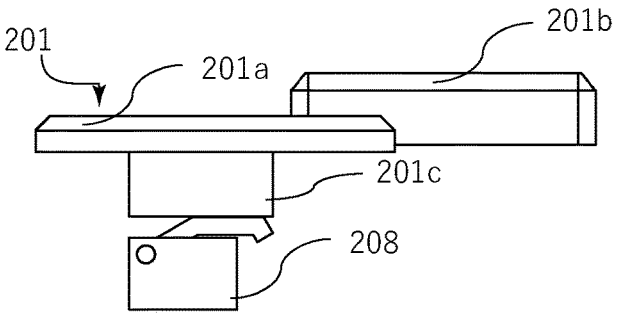
FIG. 7D is a side view showing the lever portion and the switch which are located in the replenishing position.

FIGS. 7C and 7D are side views showing the lever portion 201 and a switch 208. As shown in FIG. 7C, the lever portion 201 includes a detection rib 201*c* formed integrally with the ring portion 201*a*. The switch 208, serving as a sensor, is disposed below the ring portion 201*a*. When the lever portion 201 is located in the operating position, the switch 208 does not come into contact with the detection rib 201*c*, and is turned OFF. When the lever portion 201 is located in the replenishing position, the switch 208 comes into contact with the detection rib 201*c*, and is turned ON.

Figure 8:
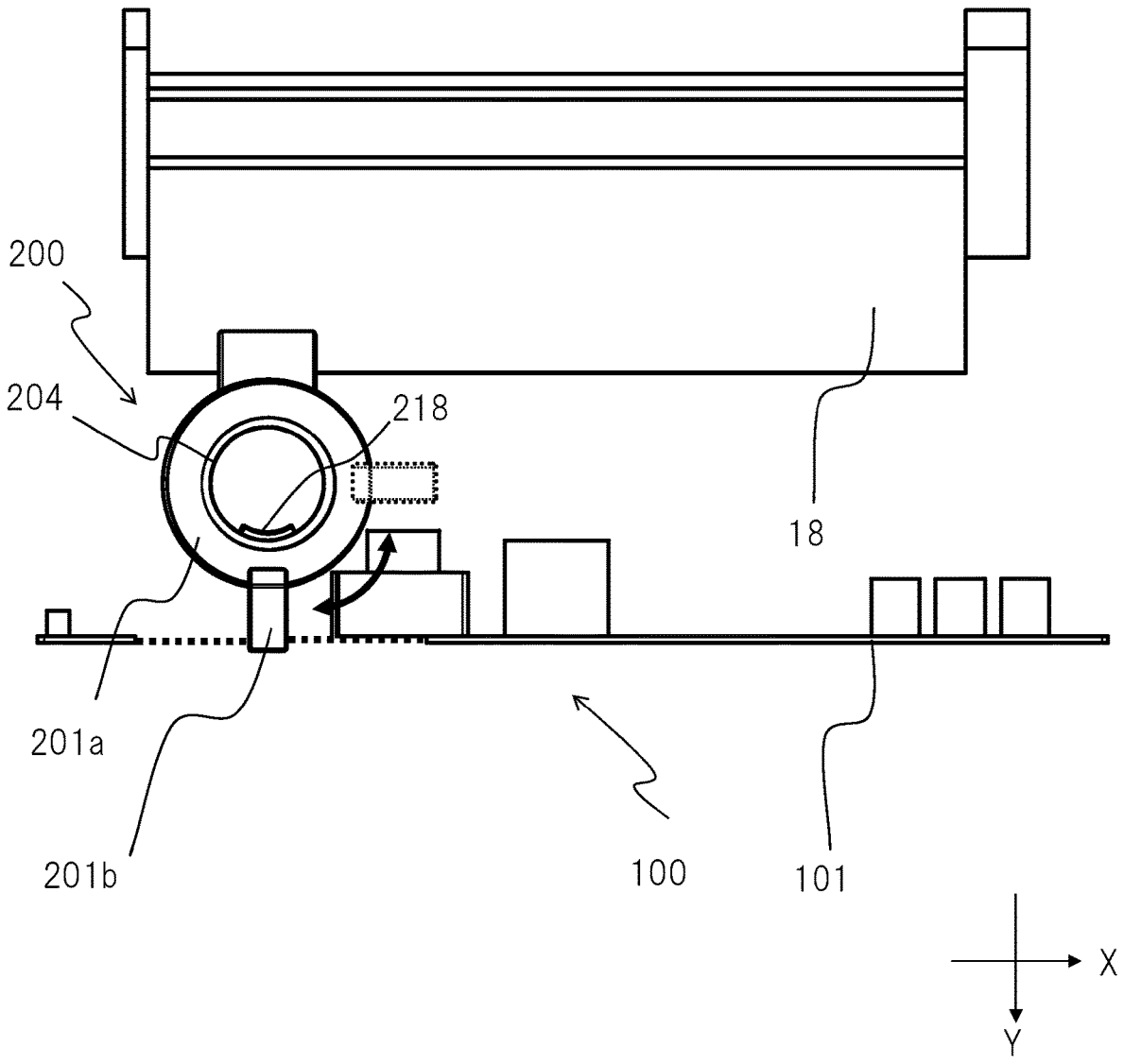
FIG. 8 is a plan view showing the replenishment unit and its adjacent configuration.

As the switch 208 is turned OFF/ON as described above, it is possible to detect whether the lever portion 201 is located in the operating position or in the replenishing position. Further, as shown in FIG. 8, an alignment rib 218 is disposed in the replenishment unit 200. The alignment rib 218 is formed, for example, in a form protruding from an inner surface of the toner receiving portion 202. A notch is formed in the body shutter member 206 so as to prevent the body shutter member 206 from interfering with the alignment rib 218 at a time when the body shutter member 206 moves between the closed position and the opening position. A role of the alignment rib 218 will be described later.

Replenishment Pack

Next, using FIG. 9, a configuration of the replenishment pack 210 will be described. The replenishment pack 210, serving as a replenishment container, includes a pouch portion 211 containing the toner for replenishment, a cylindrically shaped insertion portion 212 inserted into the replenishment port 204, and a pack shutter member 214. An opening 213 through which the toner in the pouch portion 211 is discharged is formed in the insertion portion 212.

Further, a truncated cone shaped pack bottom portion 215 is disposed at the end of the insertion portion 212, and a pouch edge 216 is formed in the pouch portion 211 at the edge opposite the insertion portion 212. The pouch portion 211 becomes a flat shape towards the pouch edge 216, and the pouch edge 216 extends in a radial direction orthogonally intersecting with a rotational axis direction of the pack shutter member 214.

The pack shutter member 214 is a cylindrically shaped member concentric with the insertion portion 212, and disposed outside in a radial direction of the insertion portion 212. The pack shutter member 214 includes an opening, not shown, and is capable of blocking and opening the opening 213 of the insertion portion 212 by rotating with respect to the insertion portion 212. When the opening of the pack shutter member 214 and the opening 213 of the insertion portion 212 overlap each other, it is possible to replenish the toner from the replenishment pack 210 to the replenishment unit 200.

Figure 9B:
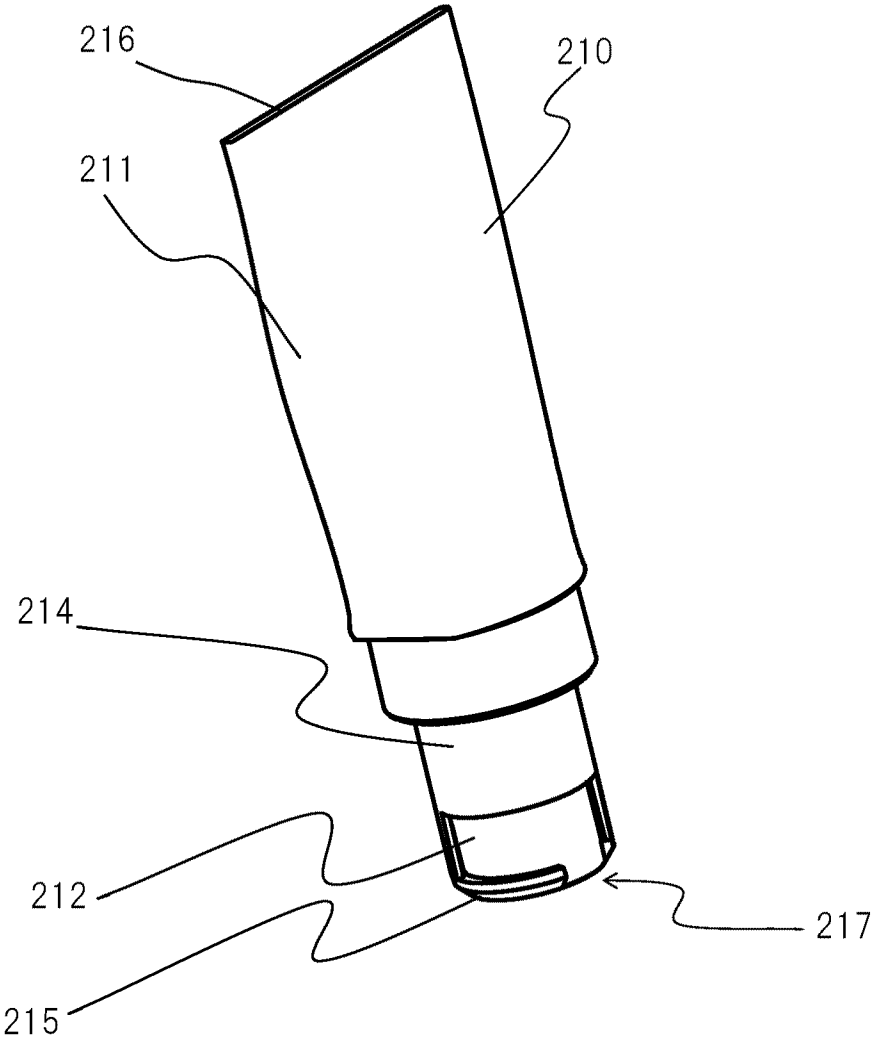
FIG. 9B is another perspective view showing the replenishment pack.
Figure 9A:
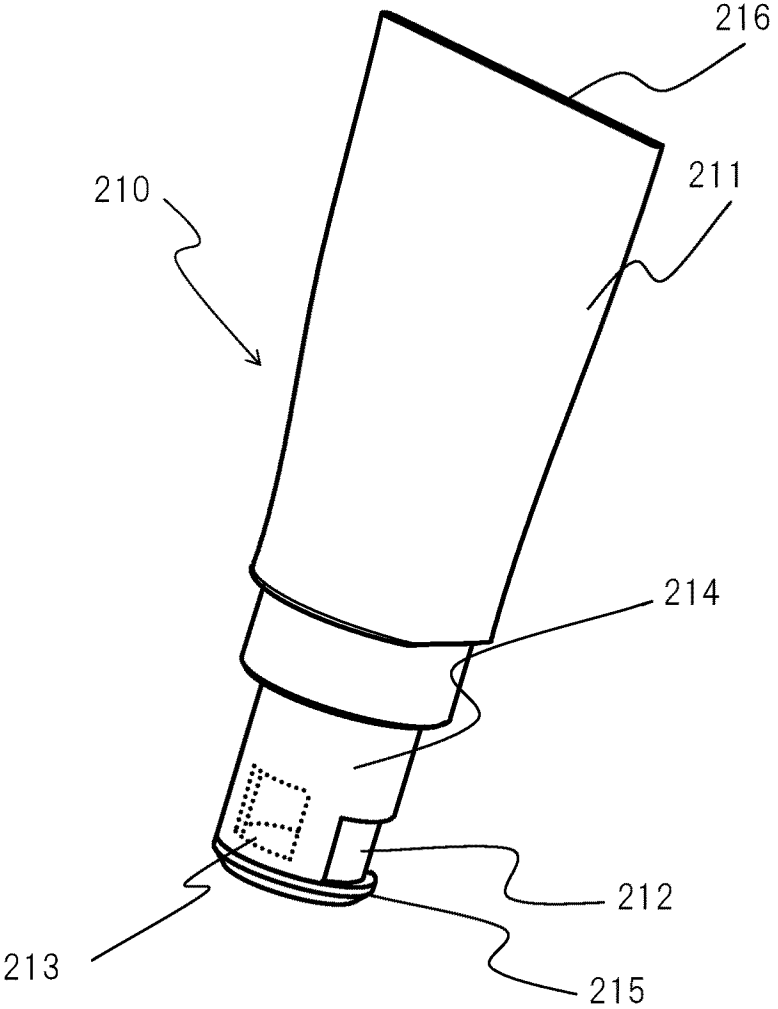
FIG. 9A is a perspective view showing a replenishment pack.

Further, as shown in FIG. 9B, an alignment notch 217 is formed in a part of the pack bottom portion 215. A role of the alignment notch 217 will be described later.

Procedure for Replenishing Toner

Next, using FIGS. 3A and 3B, FIGS. 10A and 10B, and FIG. 11, a procedure for replenishing the toner with the replenishment pack 210 will be described. At first, as shown in FIGS. 3A and 3B, the user removes the recording material P on the discharge tray 14, and opens the discharge tray 14 from the closed position to the opening position. Thereby, the replenishment unit 200 is exposed. Since the replenishment unit 200 is disposed in the upper front face of the image forming apparatus 1, it is easy to replenish the toner.

Then, the user aligns the alignment rib 218 (refer to FIG. 8) disposed in the replenishment unit 200 and the alignment notch 217 (refer to FIG. 9B) disposed in the replenishment pack 210 with each other, and attaches the replenishment pack 210 to the replenishment unit 200. In a case where positions of the alignment rib 218 and the alignment notch 217 do not correspond with each other, the pack bottom portion 215 interferes with the alignment rib 218, and it is not possible to insert the replenishment pack 210.

Figure 10A:
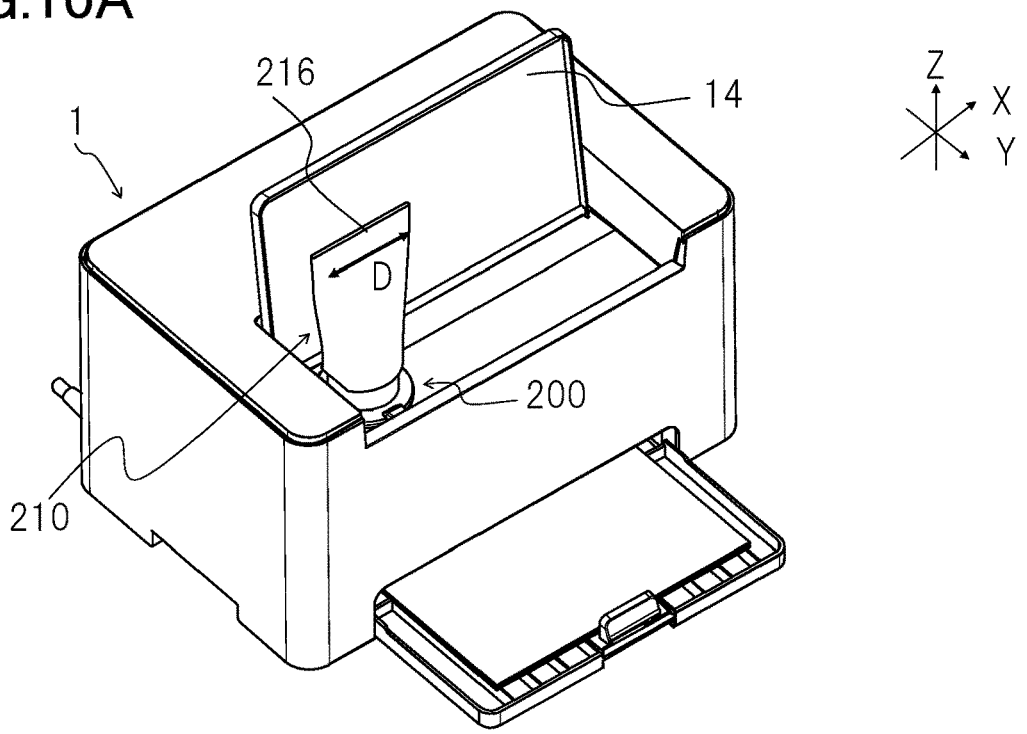
FIG. 10A is a perspective view showing the image forming apparatus in a state where the lever portion is located in the operating position.

FIG. 10A is a perspective view showing a state where the replenishment pack 210 is attached to the replenishment unit 200. As shown in FIG. 10A, in this embodiment, it is possible to attach the replenishment pack 210 to the replenishment unit 200 at a time when an arrow D direction, which is an extending direction of the pouch edge 216, is parallel to the X direction. When the replenishment pack 210 has been inserted into the back of the replenishment unit 200, the pack shutter member 214 of the replenishment pack 210 engages with the lever portion 201 by an engaging mechanism, not shown. Further, the body shutter member 206 (refer to FIG. 7A) of the replenishment unit 200 engages with the pack shutter member 214 of the replenishment pack 210 by an engaging mechanism, not shown.

That is, the rotation of the lever portion 201 is transmitted to the pack shutter member 214, and the rotation of the pack shutter member 214 is transmitted to the body shutter member 206. Thereby, the lever portion 201, the pack shutter member 214, and the body shutter member 206 are interlocked. To be noted, in a state where the replenishment pack 210 is not attached to the replenishment unit 200, the lever portion 201 and the body shutter member 206 are not interlocked with each other.

Figure 10B:
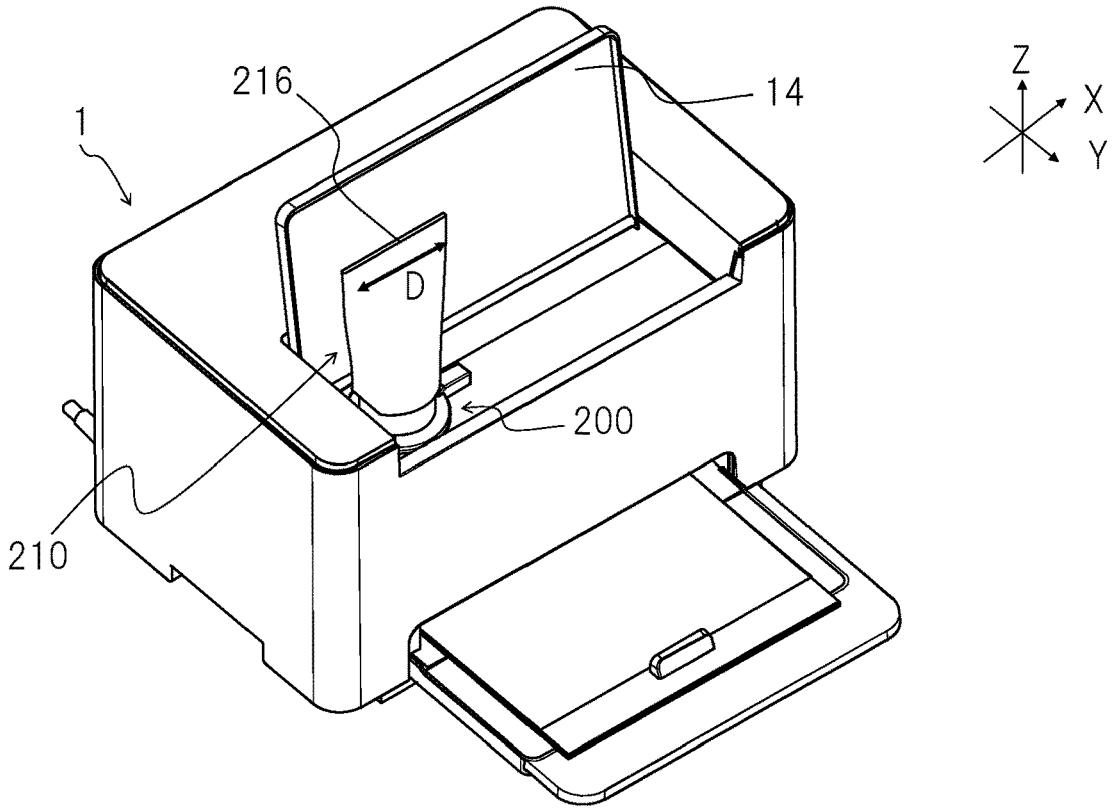
FIG. 10B is a perspective view showing the image forming apparatus in a state where the lever portion is located in the replenishing position.

Then, as shown in FIG. 10B, the user rotates the holding portion 201*b* of the lever portion 201 by 90° in the counterclockwise direction. Thereby, the lever portion 201 rotates from the operating position to the replenishing position, and the pack shutter member 214 and the body shutter member 206 rotate from the closed position to the opening position. As a result, the opening, not shown, of the pack shutter member 214, the opening 213 of the replenishment pack 210, the opening 207 of the body shutter member 206, and the side surface opening 205 of the toner receiving portion 202 overlap. Thereby, the toner in the replenishment pack 210 is discharged to the storage portion 18 through the replenishment path portion 203.

In other words, when the lever portion 201 is located in the replenishing position that is a first position, the replenishment unit 200 becomes a replenishable state where it is possible to replenish the toner to the storage portion 18. At this time, the opening 213, serving as a first opening of the replenishment pack 210, and the side surface opening 205, serving as a second opening of the toner receiving portion 202, communicate with each other.

Figure 11:
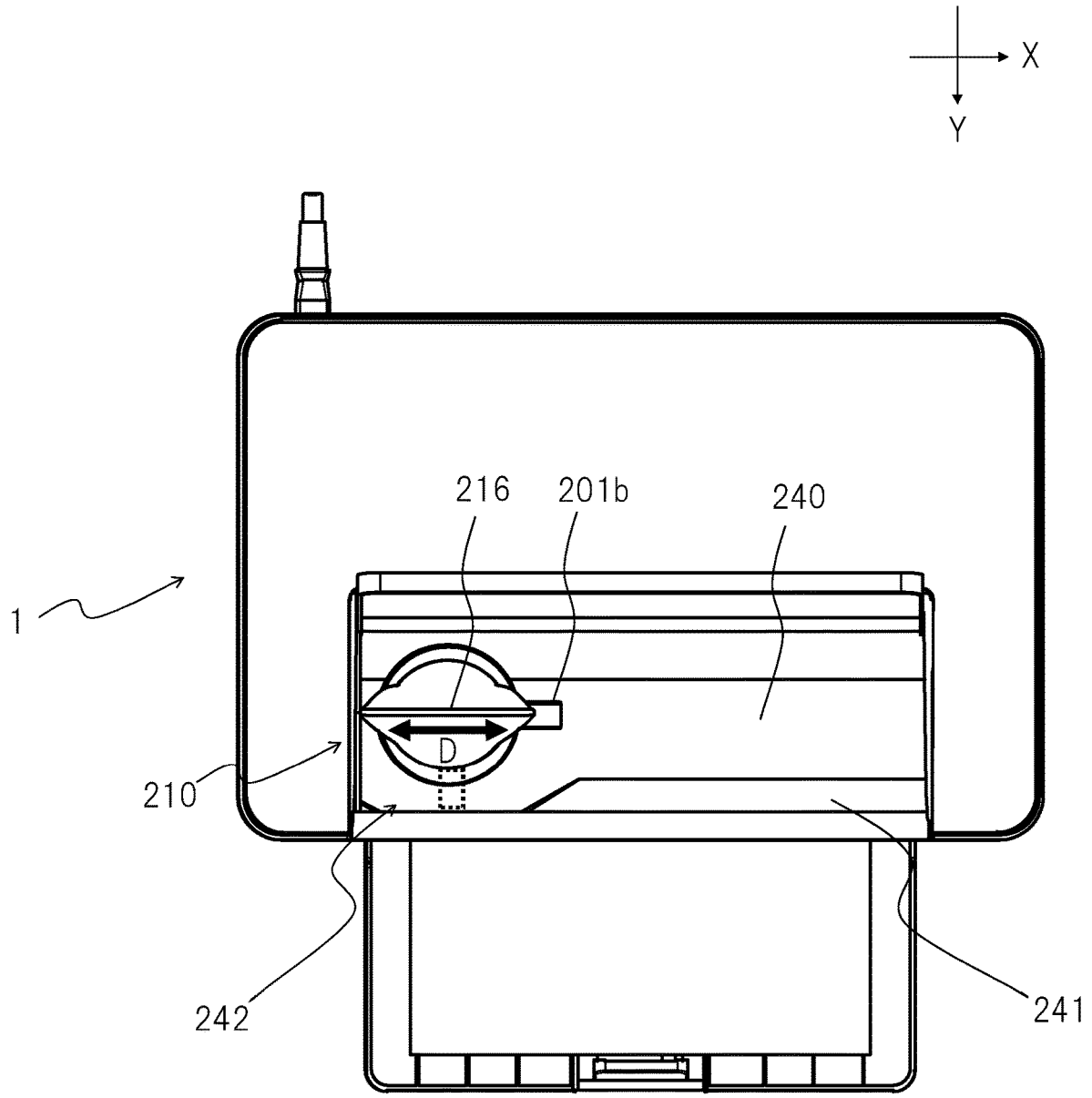
FIG. 11 is a plan view showing the replenishment unit and its adjacent configuration.

FIG. 11 is a plan view showing a state where the lever portion 201 is located in the replenishing position. A protrusion 241 protruding toward a plus (upper) side in the Z direction is formed at the edge on the plus side (near side) in the Y direction of the top surface 240 which is exposed by opening the discharge tray 14. A notch 242 is formed in a part of the protrusion 241, and the notch 242 is disposed corresponding to a rotation trajectory of the holding portion 201*b* of the lever portion 201. That is, when the lever portion 201 rotates between the operating position and the replenishing position, the notch 242 prevents the holding portion 201*b* of the lever portion 201 from interfering with the protrusion 241. Further, since it is possible for the user to operate the holding portion 201*b* by putting a finger into the notch 242, it is possible to improve operability.

When the replenishment of the toner from the replenishment pack 210 to the storage portion 18 has been completed, the user returns the lever portion 201 from the replenishing position to the operating position. That is, the user rotates the holding portion 201*b* of the lever portion 201 by 90° in a clockwise direction. Thereby, the pack shutter member 214 and the body shutter member 206 rotate from the opening position to the closed position.

In other words, when the lever portion 201 is located in the operating position that is a second position, the replenishment unit 200 becomes a replenishing disabled state where it is not possible to replenish the toner from the replenishment pack 210 to the storage portion 18. At this time, the opening 213 of the replenishment pack 210 and the side surface opening 205 of the toner receiving portion 202 do not communicate with each other.

Then, the user detaches the replenishment pack 210 from the replenishment unit 200. Since the pack shutter member 214 is located in the closed position in the state where the replenishment pack 210 is detached from the replenishment unit 200 as described above, it is possible to prevent a leakage of the toner from the opening 213 of the replenishment pack 210.

Hardware Configuration of Control Unit

Figure 12A:
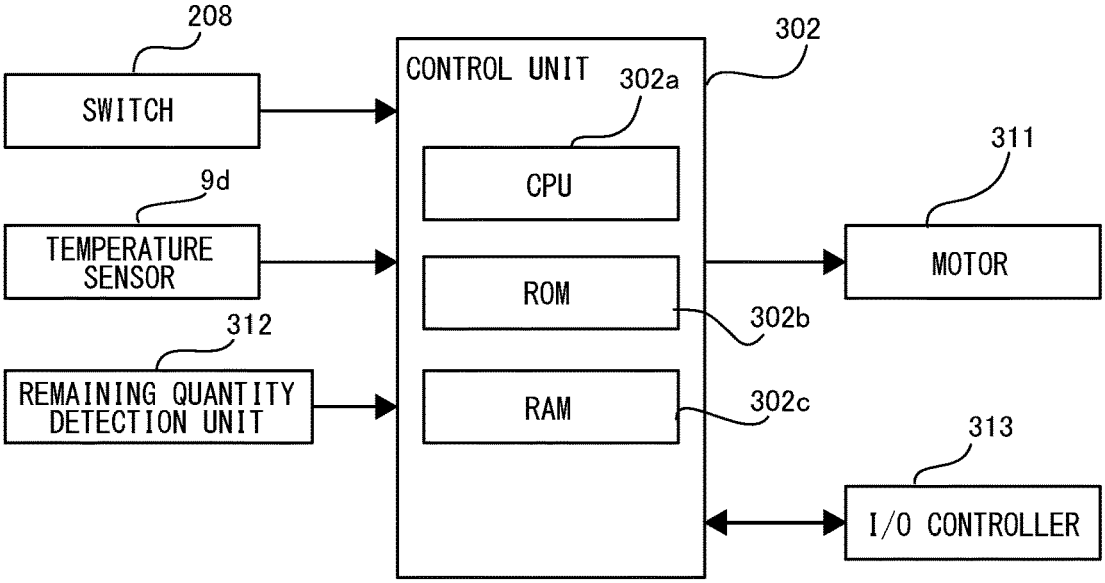
FIG. 12A is a block diagram showing a hardware configuration of the control unit.

FIG. 12A is a block diagram showing a hardware configuration of the control unit 302 disposed in the image forming apparatus 1. The control unit 302 includes a CPU (central processing unit) 302, serving as an arithmetic operation unit, the ROM 302*b*, and a RAM (random-access memory) 302*c*. The CPU 302*a* reads various programs stored in the ROM 302*b*, and performs a process. The RAM 302*c* is used as a work area of the CPU 302*a*.

The switch 208, a temperature sensor 9*d*, and the remaining amount detection unit 312 are coupled to an input side of the control unit 302. The temperature sensor 9*d* detects a temperature of a fixing nip of the fixing unit 9. A motor 311, serving as a driving source, is coupled to an output side of the control unit 302. Further, an I/O (input/output) controller 313, serving as an input/output port coupled to an external apparatus, is coupled to the control unit 302.

The motor 311 drives the agitation member 60, and various kinds of rollers (including the photosensitive drum 11, the developing roller 12, and various kinds of conveyance rollers) inside the image forming apparatus 1. To be noted, while, in this embodiment, all of the rollers inside the image forming apparatus 1 and the agitation member 60 are driven by one motor of the motor 311, it is not limited to this. For instance, it is acceptable to drive the agitation member 60 and some of the rollers inside the image forming apparatus 1 by the motor 311, and drive the other rollers by the other motor.

Functional Configuration of Control Unit

Figure 12B:
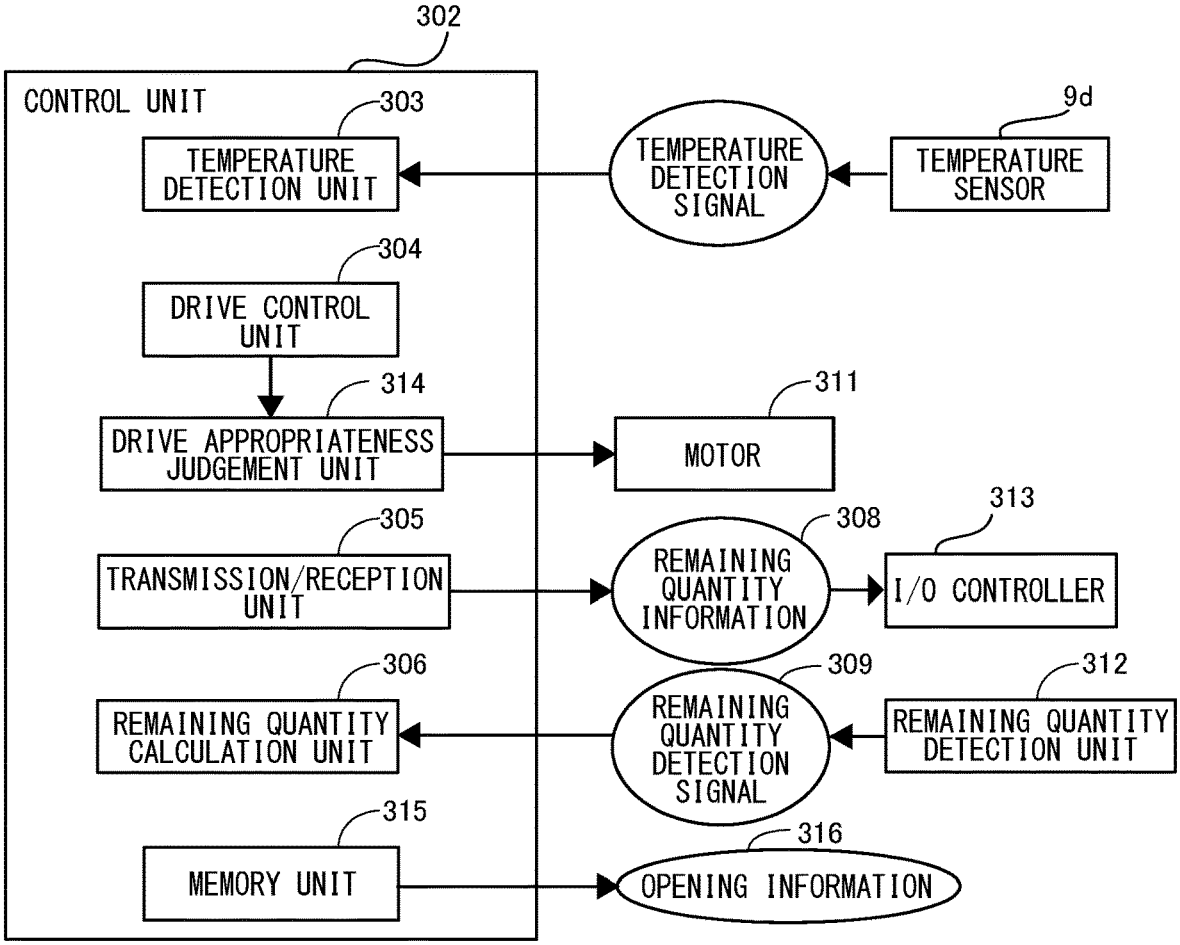
FIG. 12B is a block diagram showing a functional configuration of the control unit.

FIG. 12B is a block diagram showing a functional configuration of the control unit 302 disposed in the image forming apparatus 1. The control unit 302 includes a temperature detection unit 303, a drive control unit 304, a transmission/reception unit 305, a remaining amount calculation unit 306, and a memory unit 315. The temperature detection unit 303 detects a current temperature of the fixing unit 9 based on a temperature signal from the temperature sensor 9*d*. The drive control unit 304 controls a drive of the motor 311 as necessary based on a print operation, an initial control, or the like of the image forming apparatus 1.

Based on a state of the image forming apparatus 1, a drive appropriateness judgement unit 314 judges whether or not it is appropriate to drive the motor 311. For instance, in a jam state where the recording material P is retained inside the image forming apparatus 1, a failure condition, or the like, the drive appropriateness judgement unit 314 does not allow the motor 311 to drive. The drive control unit 304 drives the motor 311 based on a judgement of the drive appropriateness judgement unit 314.

The remaining amount calculation unit 306 calculates an amount of the toner stored in the storage portion 18 based on a remaining amount detection signal 309 output by the remaining amount detection unit 312 disposed in the storage portion 18. The transmission/reception unit 305 performs the transmission and reception of information to and from the I/O controller 313 which receives the image information from a host such as a PC (personal computer), not shown, and, in this embodiment, particularly transmits the remaining amount of the toner stored in the storage portion 18 as a remaining amount information 308.

Here, the remaining amount of the toner is transmitted, for example, in a percentage by setting an amount of the toner storable in the storage portion 18 at 100%. Further, depending on a configuration of the remaining amount detection unit 312, the remaining amount detection signal 309 is, for example, an analog signal which changes a voltage based on the remaining amount of the developer or, for example, a pulse signal which changes a H/L (high/low) pulse width corresponding to the remaining amount of the toner in a state where a pulse signal of a fixed cycle is output. The memory unit 315 stores opening information 316 regarding the opening state of the replenishment unit 200, that is, whether or not the body shutter member 206 is located in the opening position. A process regarding the recording of the opening information 316 on the memory unit 315 will be described later in FIG. 13. To be noted, in this embodiment, the memory unit 315 corresponds to the RAM 302*c*.

Replenishing Operation and Recording of Opening Information

Figure 13:
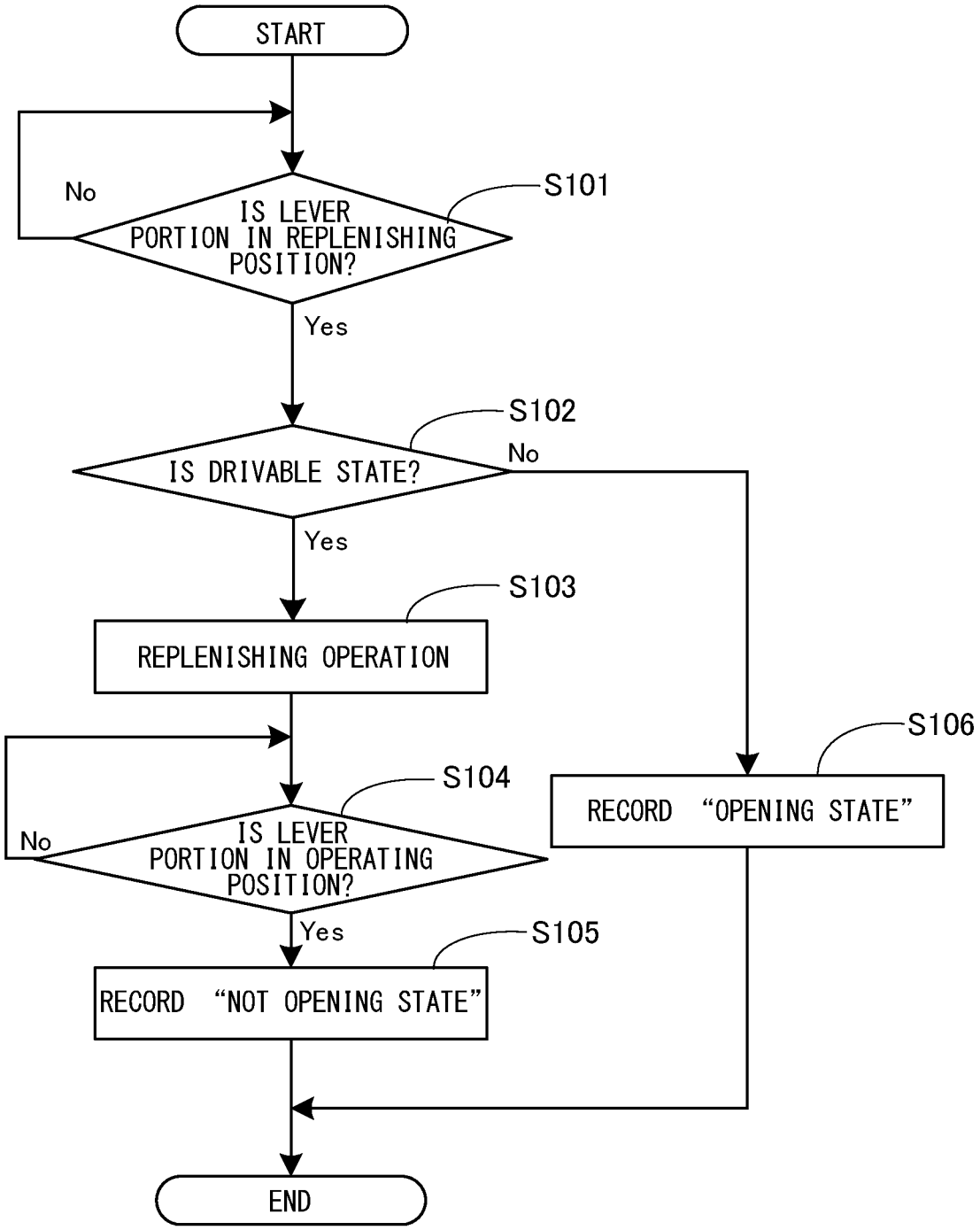
FIG. 13 is a flowchart showing a replenishing operation and a recording method of open information.

Next, using FIG. 13, a replenishing operation and the recording method of the opening information 316 will be described. As shown in FIG. 13, at first, the control unit 302 judges based on a detection result of the switch 208 whether or not the lever portion 201 is located in the replenishing position (STEP S101). In this embodiment, as described above, the replenishment of the toner from the replenishment pack 210 to the storage portion 18 is performed by attaching the replenishment pack 210 to the replenishment unit 200 and rotating the lever portion 201 from the operating position to the replenishing position.

In a case where it is judged that the lever portion 201 is located in the replenishing position (STEP S101: YES), the control unit 302 judges whether or not it is a drivable state where the drive appropriateness judgement unit 314 allows the motor 311 to drive (STEP S102). Here, the state (drivable state) where the motor 311 is allowed to drive indicates a state where the motor 311 is able to drive the agitation member 60. Further, a state (driving disabled state) where the motor 311 is not allowed to drive indicates a state where the motor 311 is not able to drive the agitation member 60. If a configuration is such that the motor 311 drives all of the rollers in the image forming apparatus 1 and the agitation member 60 as described above, for example, a state where it is possible to perform the print operation smoothly in a state where the motor 311 is driven is the drivable state. Further, in a case where a defect occurs, it is judged that it is the driving disabled state.

In a case where it is judged to be the drivable state (STEP S102: YES), the control unit 302 drives the motor 311, and performs the replenishing operation (STEP S103). The replenishing operation is an operation by which the motor 311 is driven for the duration of predetermined time so as to agitate the toner in the storage portion 18 adequately and put the toner in the storage portion 18 into a uniform state.

That is, while the toner replenished from the replenishment unit 200 to the storage portion 18 is discharged to one end in a longitudinal direction (X direction) of the storage portion 18, the toner is unevenly distributed in the storage portion 18 in this state. Then, it is not possible for the remaining amount detection unit 312 to detect the remaining amount of the toner in the storage portion 18 correctly. Further, in this embodiment, since the method of measuring the duration of the light blocking time by the toner, which is being agitated, using the light emitting portion 312*a* and the light receiving portion 312*b* is applied to the remaining amount detection unit 312, it is not possible to detect the remaining amount of the toner correctly unless the agitation member 60 is being driven.

When the replenishing operation has been completed in STEP S103, the control unit 302 judges based on the detection result of the switch 208 whether or not the lever portion 201 is located in the operating position (STEP S104). That is, the control unit 302 judges whether or not the user has returned the lever portion 201 from the replenishing position to the operating position after the replenishment of the toner from the replenishment pack 210 to the storage portion 18 was completed. In a case where the lever portion 201 is located in the operating position (STEP S104; YES), the control unit 302 records the opening information 316 of the transmission/reception unit 305 as "not opening state" (STEP S105). In other words, in a case where the opening information 316 of the transmission/reception unit 305 is stored as "opening state", the control unit 302 deletes this. Then, the control unit 302 ends the process.

On the other hand, in a case where, in STEP S102, it is judged as not the drivable state (STEP S102: NO), the control unit 302 records the opening information 316 of the transmission/reception unit 305 as "opening state" (STEP S106). In other words, "opening state" is a state where the motor 311 is not allowed to drive, and indicates the information that the replenishment unit 200 has transitioned to a replenishable state. Then, the control unit 302 ends the process.

To be noted, since it is not possible to confirm the position of the lever portion 201 by the switch 208 when a power to the image forming apparatus 1 is turned OFF, there is a possibility that the lever portion 201 has been operated during a time when the power to the image forming apparatus 1 has been turned OFF. That is, the image forming apparatus 1 is not able to acknowledge the replenishment of the toner in a case where the toner has been replenished from the replenishment pack 210 to the storage portion 18 during the power OFF. Therefore, an initial value of the opening information 316 at a time when the power to the image forming apparatus 1 is switched from OFF to ON, that is, when the power is turned ON is set at "opening state".

Initial Control

Next, using FIG. 14, the initial control will be described. The initial control is the control performed so as to bring the image forming apparatus 1 to a state capable of performing the image formation, and, for example, performed at times of the power ON, sleep restoration, and jam removal in the image forming apparatus 1.

Figure 14:
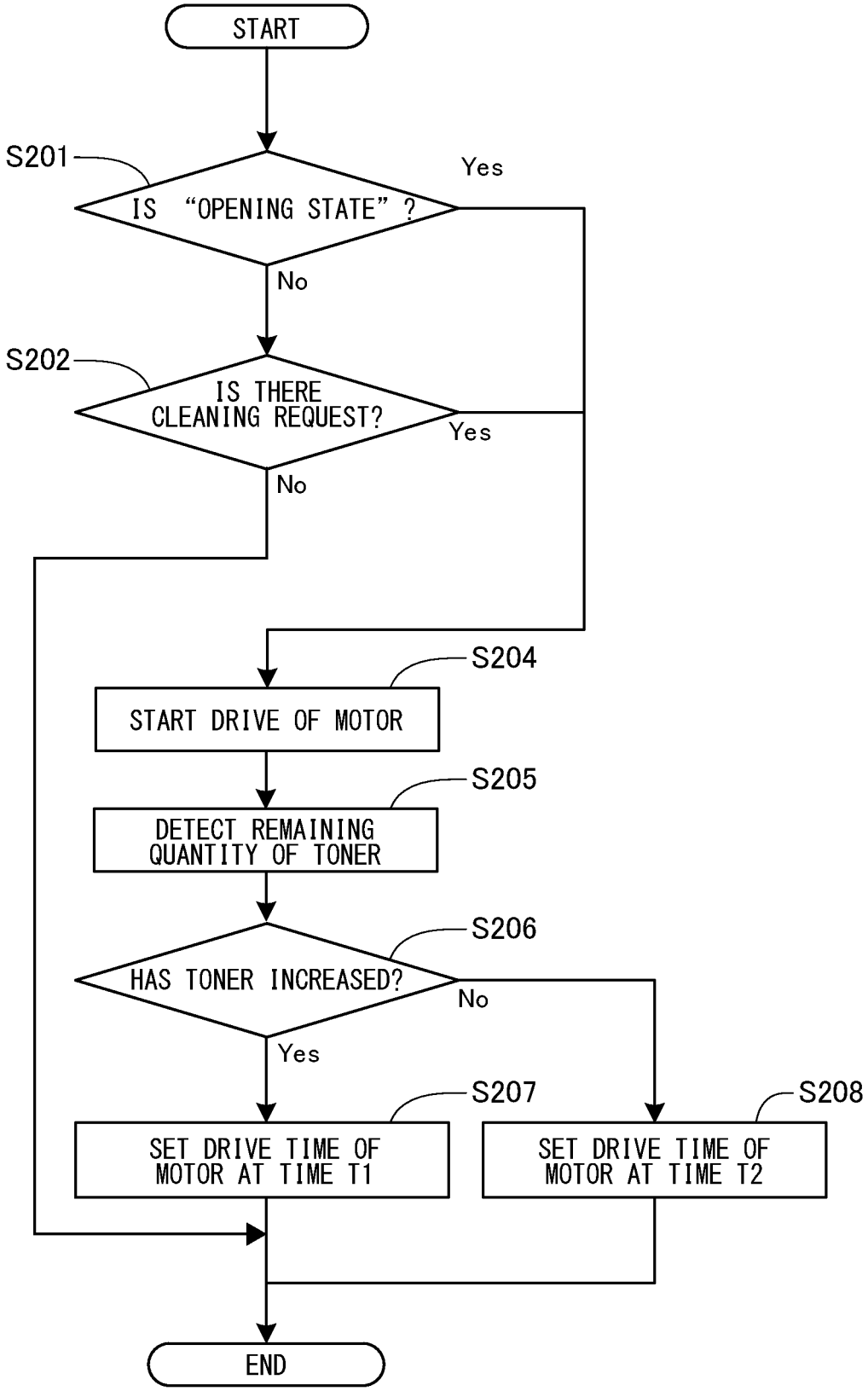
FIG. 14 is a flowchart showing an initial control.

When the initial control is started, as shown in FIG. 14, the control unit 302 judges whether or not the opening information 316 stored in the memory unit 315 is "opening state" (STEP S201). In a case where it is judged as not "opening state", that is, judged as "not opening state" (STEP S201: NO), the control unit 302 judges whether or not there is a cleaning request (STEP S202). To be noted, in the initial control on a return from the jam, it is necessary to perform the cleaning of the photosensitive drum 11 and the like, so it is judged that there is the cleaning request. Since, in this embodiment, it is possible to apply any sequence to a cleaning method of the process unit 40, descriptions of the cleaning method will be omitted herein.

In a case where it is judged that there is not the cleaning request (STEP S202: NO), the control unit 302 ends the initial control without driving the motor 311. Since the motor 311 is not driven in this case, also the agitation member 60 is not driven.

In a case where it is judged that it is "opening state" (STEP S201: YES), or in a case where it is judged that there is the cleaning request (STEP S202: YES), the control unit 302 starts the drive of the motor 311 (STEP S204). Thereby, the agitation member 60 is driven.

Next, the control unit 302 detects the remaining amount of the toner in the storage portion 18 by the remaining amount detection unit 312 (STEP S205). Since the agitation member 60 is rotating at this time, it is possible to detect the remaining amount of the toner by the remaining amount detection unit 312 correctly. Then, the control unit 302 judges based on the remaining amount of the toner detected by the remaining amount detection unit 312 whether or not the remaining amount of the toner in the storage portion 18 has increased after a start of the drive of the motor 311 (STEP S206).

Whether or not the remaining amount of the toner has increased is judged as follows. That is, the remaining amount of the toner in the storage portion 18 before the opening information 316 has been brought to "opening state" (hereinafter referred to as a first remaining amount of the toner) is stored in the memory unit 315. Then, the control unit 302 compares the remaining amount of the toner detected by the remaining amount detection unit 312 in STEP S205 (hereinafter referred to as a second remaining amount of the toner) with the first remaining amount of the toner above. In a case where the second remaining amount of the toner has increased from the first remaining amount of the toner by at least a predetermined amount, it is judged that the remaining amount of the toner in the storage portion 18 has increased, and, in a case where the second remaining amount of the toner has not increased from the first remaining amount of the toner by at least the predetermined amount, it is judged that the remaining amount of the toner has not increased.

In a case where it is judged that the remaining amount of the toner has increased (STEP S206: YES), the control unit 302 sets a drive time of the motor 311 at the time T1 that is first time, and agitates the toner in the storage portion 18 by the agitation member 60 (STEP S207). That is, it is necessary to adequately agitate the toner in the storage portion 18 by the agitation member 60 by supposing that the toner has been replenished from the replenishment pack 210 to the storage portion 18 in a state where the motor 311 is not allowed to drive at the time of the jam, the power OFF, or the like. STEP S207 serves as a first operation and a first mode which drives the motor 311 so as to drive the agitation member 60 for the time T1.

On the other hand, in a case where it is judged that the remaining amount of the toner has not increased (STEP S206: NO), the control unit 302 sets the drive time of the motor 311 at the time T2, serving as a second time, that is shorter than the time T1 (STEP S208). That is, while the opening information 316 is "opening state", the drive time of the motor 311 is shortened by supposing that the toner has not been replenished from the replenishment pack 210 to the storage portion 18 in a state where the motor 311 is not allowed to drive at the time of the jam, the power OFF, or the like. STEP S208 serves as a second operation and a second mode which drives the motor 311 so as to drive the agitation member 60 for the time T2.

To be noted, the time T1 and the time T2 are the duration of time since the drive of the motor 311 was started in STEP S204, and it is preferable that the time T2 is the same as the time TO required for detecting the remaining amount of the toner in the storage portion 18 in STEP S205.

$$T2=T0$$

Then, the time T1 includes the time T11 required for adequately agitating the toner in the storage portion 18 in addition to the time T0 required for detecting the remaining amount of the toner.

$$T1=T0+T11$$

To be noted, in this embodiment, the time T11 required for the replenishing operation is determined based an increased amount of the remaining amount of the toner in STEP S206. That is, the time T1 becomes longer as the remaining amount of the toner is increased. Further, it is acceptable to set the time T11 at a constant value regardless of the increased amount of the toner.

After the processes in STEPS S207 and 208, that is, the motor 311 is driven for the time T1 or the time T2, the control unit 302 ends the process. To be noted, in STEPS S204 to S207, it is acceptable to perform the replenishing operation by driving the agitation member 60 and perform operations other than the replenishing operation, such as the cleaning operation of the process unit 40, in parallel or in sequence.

As described above, in this embodiment, it is possible to perform the initial control properly by using the opening information 316 stored in the memory unit 315 and the detection result of the remaining amount detection unit 312. That is, based on the operation of the lever portion 201 to the replenishing position performed in a state where the motor 311 is not allowed to drive, or based on turning ON the power of the image forming apparatus 1, "opening state" is stored in the opening information 316. However, since it is not possible to judge with this alone whether or not the toner has been replenished from the replenishment pack 210 to the storage portion 18, an increase in the remaining amount of the toner is verified in the initial control based on the detection result of the remaining amount detection unit 312.

Then, in a case where it is necessary to adequately drive the agitation member 60 since the toner has been replenished from the replenishment pack 210 to the storage portion 18, the drive time of the motor 311 is set at the time T1 that is relatively long time. Thereby, the toner in the storage portion 18 becomes uniformly flat in the X direction (longitudinal direction of the developer container 230), and it is possible to suppress an image defect generated by a short supply of the toner to the developing roller 12.

Further, in a case where it is not necessary to drive the agitation member 60 for long time since the toner has not been replenished from the replenishment pack 210 to the storage portion 18, the drive time of the motor 311 is set at the time T2 that is shorter than the time T1. Therefore, it is possible to suppress unnecessarily lengthening of the agitation time of the agitation member 60. Further, it is possible to shorten downtime not capable of performing the print operation, and also extend a life of the image forming apparatus 1.

Further, only a single motor (the motor 311) is disposed in the image forming apparatus 1 of this embodiment, and drives the agitation member 60 and the various rollers inside the image forming apparatus 1 (including the photosensitive drum 11, the developing roller 12, and the conveyance rollers). Therefore, it is possible to miniaturize the image forming apparatus 1 and reduce a cost.

Second Embodiment

While a second embodiment of this disclosure will be described next, the initial control of the first embodiment is changed in the second embodiment. Therefore, configurations similar to the first embodiment will be described by omitting illustrations or by putting the same reference characters on drawings herein.

Initial Control

Figure 15:
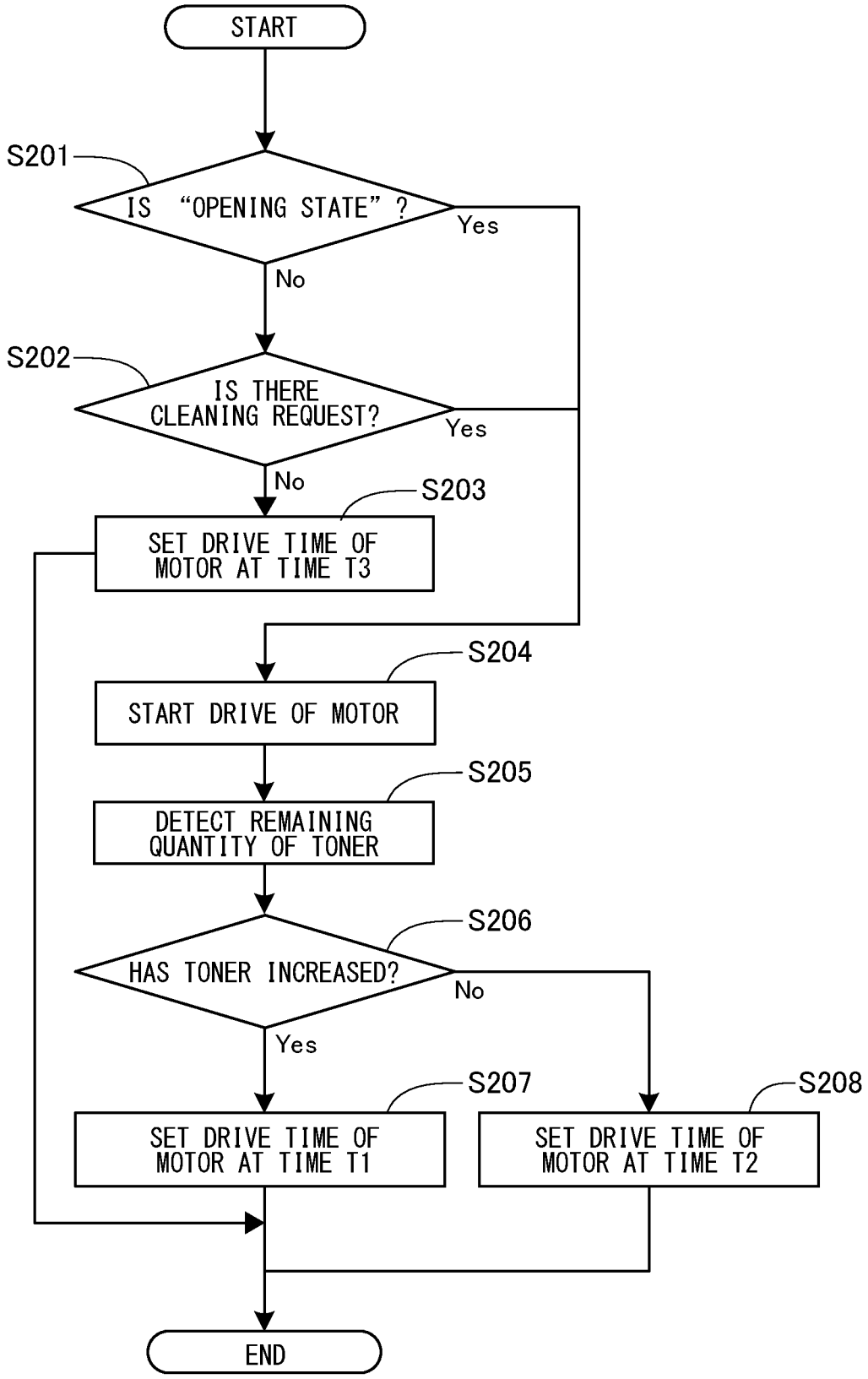
FIG. 15 is a flowchart showing an initial control according to a second embodiment.

While an initial control according to this embodiment will be described using FIG. 15, since STEPS S201 to S208 in FIG. 15 are the same as STEPS S201 to S208 in FIG. 14, descriptions of STEPS S201 to S208 will be omitted herein. In FIG. 15, STEP S203 is added to the sequence shown in FIG. 14.

As shown in FIG. 15, in a case where it is judged that there is not the cleaning request (STEP S202: NO), the control unit 302 sets the drive time of the motor 311 at the time T3 that is third time, and drives the motor 311 for the time T3 (STEP S203). The time T3 is set at shorter than the time T1 (T3<T1). STEP S203 serves as a third operation which drives the motor 311 so as to drive the agitation member 60 for the time T3.

To be noted, while the time T3 which is either longer or shorter than the time T2 is acceptable, preferably, the time T3 is set at shorter than the time T2. Then, the control unit 302 drives the motor 311 for the time T3, and ends the process.

As described above, in this embodiment, even if the opening information 316 is "not opening state" and there is not the cleaning request, the agitation member 60 is driven in the initial control by driving the motor 311 for the time T3. Thereby, if the toner inside the storage portion 18 is stiffened because of, for example, the extended time of the power OFF, it is possible to loosen the toner by the agitation member 60, and suppress the image defect.

Further, since the drive time of the motor 311 at this time is set at the time T3 which is shorter than the time T1, it is possible to shorten the downtime, and extend the life of the image forming apparatus 1.

Third Embodiment

While a third embodiment of this disclosure will be described next, the replenishing operation and the recording method of the opening information 316 in the first embodiment are changed in the third embodiment. Therefore, configurations similar to the first embodiment will be described by omitting illustrations or by putting the same reference characters on drawings herein.

Replenishing Operation and Recording Method of Opening Information

Figure 16:
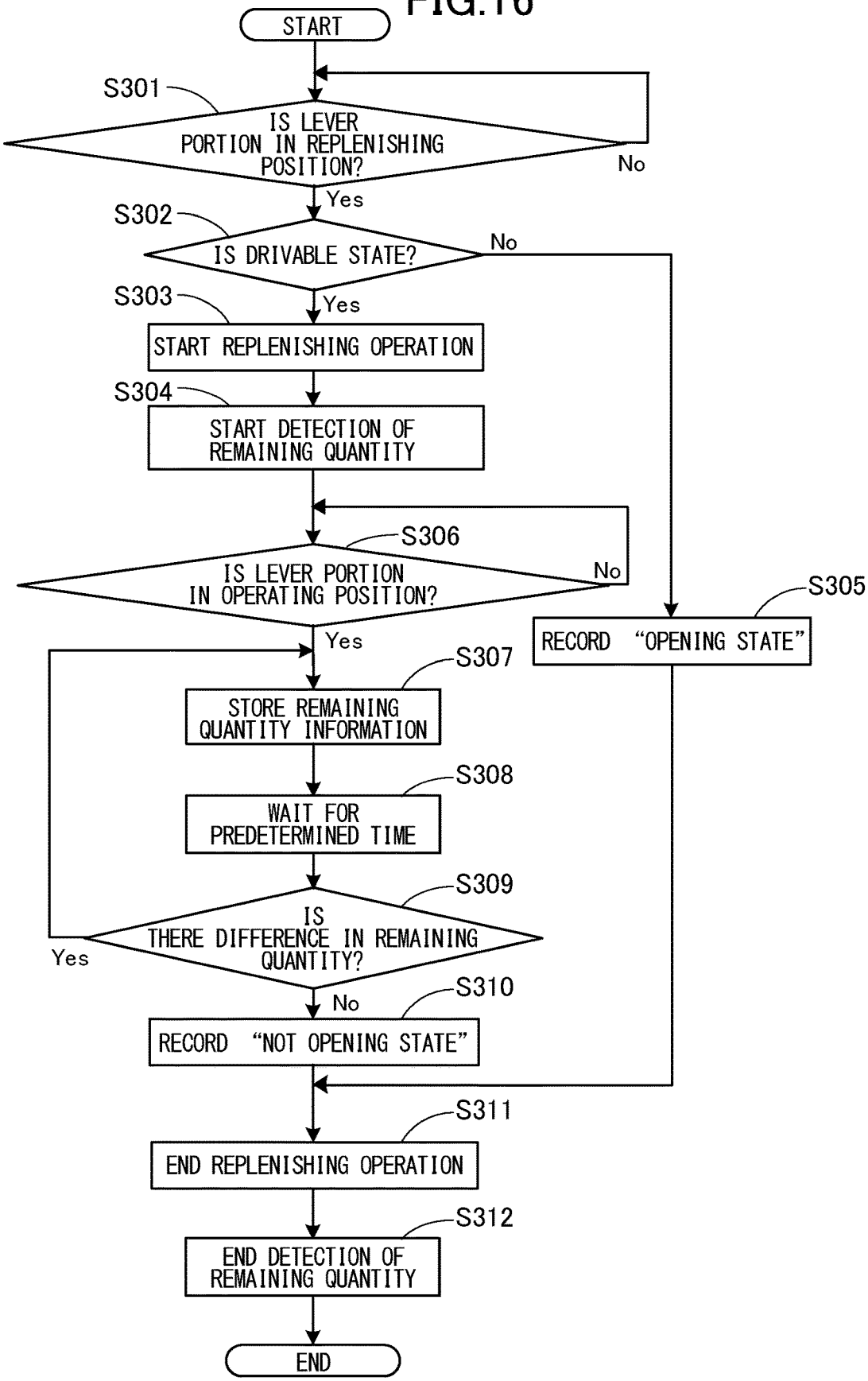
FIG. 16 is a flowchart showing a replenishing operation and a recording method of open information according to a third embodiment.

FIG. 16 is a flowchart relating to the replenishing operation and the recording method of the opening information. Since STEPS S301, S302, and S305 in FIG. 16 are the same as STEPS S101, S102, and S106 in FIG. 13, descriptions of these STEPS will be omitted herein. To be noted, in this embodiment, the time T0 required for detecting the remaining amount of the toner in the storage portion 18 is longer than the time required for the agitation of the toner in the storage portion 18, that is, the time T11 required for the replenishing operation. Then, in a case where the remaining amount has not increased after the remaining amount of the toner in the storage portion 18 was detected for a predetermined period of time, the replenishing operation is ended.

As shown in FIG. 16, in a case where it is judged that it is in the drivable state in STEP S302 (STEP S302: YES), the control unit 302 drives the motor 311, and starts the replenishing operation (STEP S303). Next, the control unit 302 starts the detection of the remaining amount of the toner with the remaining amount detection unit 312 (STEP S304).

Then, the control unit 302 judges based on the detection result of the switch 208 whether or not the lever portion 201 is in the operating position (STEP S306). That is, whether or not the user has returned the lever portion 201 from the replenishing position to the operating position after the replenishment of the toner from the replenishment pack 210 to the storage portion 18 was completed is judged. In a case where it is judged that the lever portion 201 is in the operating position (STEP S306: YES), the control unit 302 stores the information on the remaining amount of the toner in the storage portion 18 detected by the remaining amount detection unit 312 in the memory unit 315 (STEP S307). There is a slight time difference before it becomes possible to detect the remaining amount of the toner in the storage portion 18 correctly after the lever portion 201 has been moved to the operating position.

Then, having waited for predetermined time, the control unit 302 judges by comparing the information on the remaining amount of the toner in the storage portion 18 detected by the remaining amount detection unit 312 with the information on the remaining amount stored in the memory unit 315 in STEP 307 whether or not there is a difference in the remaining amount (STEP S309).

In a case where it is judged that there is a difference in the remaining amount of the toner (STEP S309: YES), the control unit 302 returns to STEP S307, and repeats STEPS S307 to S309 again. In a case where it is judged that there is not a difference in the remaining amount of the toner (STEP S309: NO), since it means the completion of the replenishing operation, that is, the agitation of the toner by the agitation member 60, the control unit 302 records "not opening state" as the opening information 316 of the memory unit 315. Then, the control unit 302 ends the replenishing operation by stopping the drive of the motor 311, and ends the detection of the remaining amount of the toner by the remaining amount detection unit 312 (STEPS S311 and S312). Thus, the control unit 302 ends the process. Since the initial control is similar to the first embodiment, descriptions will be omitted herein.

Since, in this embodiment, the completion of the replenishing operation is judged using the detection result of the remaining amount detection unit 312 as described above, it is possible to perform the replenishing operation properly. That is, it is possible to realize the suppression of the image defect, shortened downtime, and an extended life of the image forming apparatus 1.

Fourth Embodiment

While a fourth embodiment of this disclosure will be described next, the replenishing operation and the recording method of the opening information 316 in the first embodiment are changed in the fourth embodiment. Therefore, configurations similar to the first embodiment will be described by omitting illustrations or by putting the same reference characters on drawings herein.

Replenishing Operation and Recording Method of Opening Information

Figure 17:
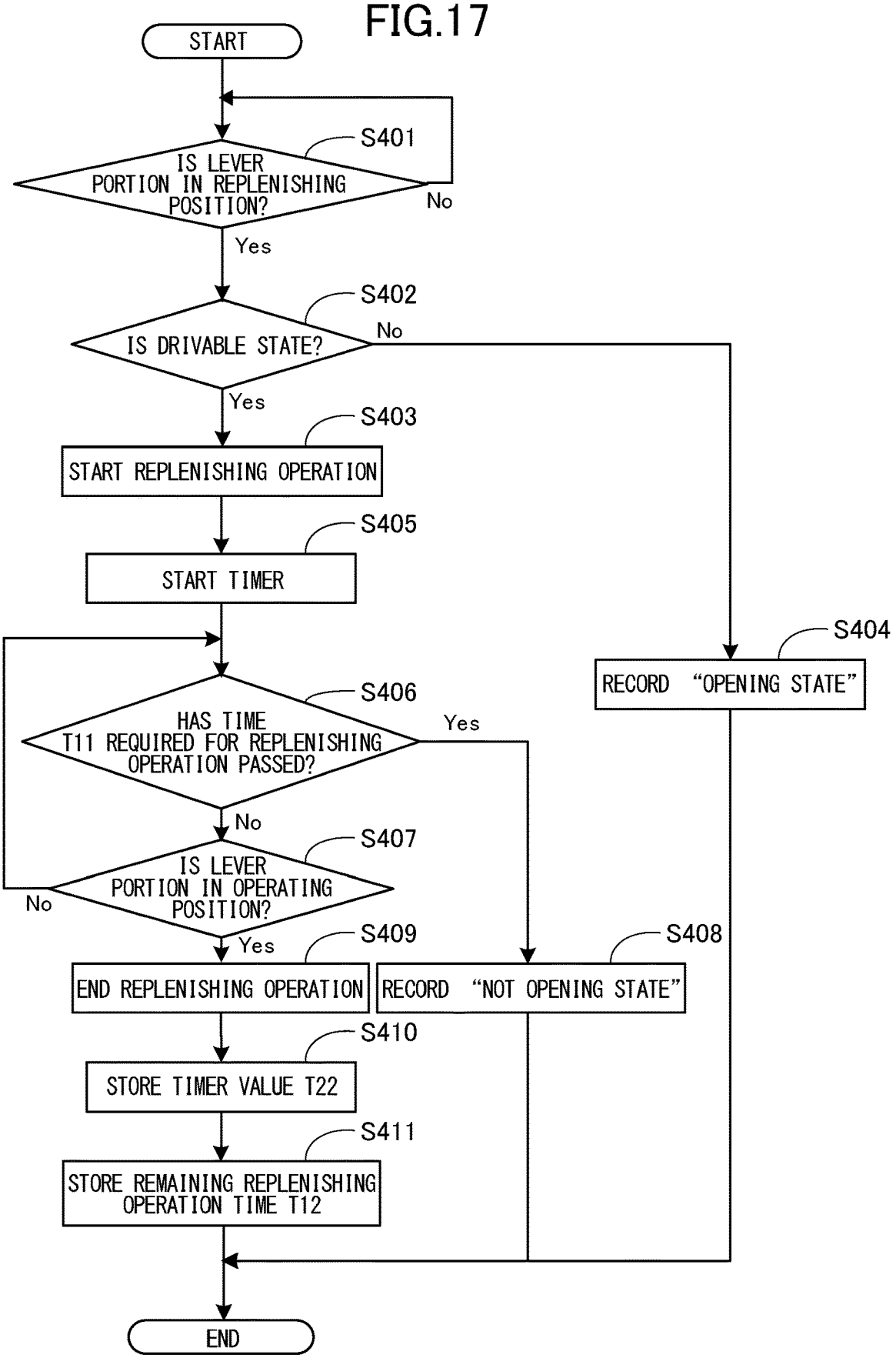
FIG. 17 is a flowchart showing a replenishing operation and a recording method of open information according to a fourth embodiment.

FIG. 17 is a flowchart relating to the replenishing operation and the recording method of the opening information 316 according to this embodiment. Since STEPS S401, S402, and S404 in FIG. 17 are the same as STEPS S101, S102, and S106 in FIG. 13, descriptions will be omitted herein.

As shown in FIG. 17, in a case where it is judged in STEP S402 that it is the drivable state (STEP S402: YES), the control unit 302 drives the motor 311, and starts the replenishing operation (STEP S403). Next, the control unit 302 starts a timer so as to measure an execution time of the replenishing operation (STEP S405). Then, the control unit 302 refers to the timer, and judges whether or not the time T11 required for the replenishing operation has passed (STEP S406). In a case where the time T11 required for the replenishing operation has passed (STEP S406: YES), the control unit 302 records "not opening state" as the opening information 316 of the memory unit 315 (STEP S408), and ends the process.

In a case where the time T11 required for the replenishing operation has not passed (STEP S406: NO), the control unit 302 judges based on the detection result of the switch 208 whether or not the lever portion 201 is in the operating position (STEP S407). That is, the control unit 302 judges whether or not the user has returned the lever portion 201 from the replenishing position to the operating position after the replenishment of the toner from the replenishment pack 210 to the storage portion 18 was completed. In a case where it is judged that the lever portion 201 is not in the operating position (STEP S407: NO), the control unit 302 returns to STEP S406.

In a case where it is judged that the lever portion 201 is in the operating position (STEP S407: YES), the control unit 302 ends the replenishing operation by stopping the drive of the motor 311, and stores a value T22 of the timer in the memory unit 315 (STEPS S409 and S410). Further, the control unit 302 calculates remaining replenishing operation time T12 from the equation below, and stores the time T12 in the memory unit 315 (STEP S411). Thereafter, the control unit 302 ends the process.

$$T12=T11-T22$$

To be noted, since the initial control is similar to the first embodiment, descriptions will be omitted herein. Further, in a case where the remaining replenishing operation time T12 is stored in the memory unit 315, it is acceptable to change the initial control in the first embodiment. For instance, in a case where the time during which the motor 311 is driven in the initial control is referred to as time T, and in a case where the time T is equal to or less than the remaining replenishing operation time T12, the control unit 302 drives the motor 311 for the time T in the initial control. Further, in a case where the remaining replenishing operation time T12 is larger than the time T, the control unit 302 extends the drive time of the motor 311, that is, the replenishment time by the time corresponding to a difference between the time T12 and the time T (T12−T). Further, it is acceptable to drive the motor 311 for the remaining replenishing operation time T12 in a control sequence other than the initial control.

As described above, by this embodiment, even in a case where the replenishing operation is ended by the operation of the lever portion 201 by the user, it is possible to store the remaining replenishing operation time T12. Therefore, it is possible to perform the replenishing operation with a certainty, and suppress the image defect.

Other Embodiments

To be noted, while, in any of the embodiments described above, the replenishment unit 200 is capable of transitioning between the replenishable state and the replenishing disabled state by operating the lever portion 201 in a state where the replenishment pack 210 is attached to the replenishment unit 200, it is not limited to this. For instance, it is acceptable to configure such that, instead of operating the lever portion 201, the replenishment unit 200 is capable of transitioning between the replenishable state and the replenishing disabled state by rotating the replenishment pack 210. That is, it is acceptable to rotate the pack shutter member 214 and the body shutter member 206 in conjunction with the rotation of the replenishment pack 210. Further, it is acceptable that either one of the pack shutter member 214 and the body shutter member 206 rotates in conjunction with the rotation of the replenishment pack 210.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-035218, filed Mar. 5, 2021, which is hereby incorporated by reference herein in its entirety.

What is claimed is:

1. An image forming apparatus comprising:

an image bearing member configured to bear a toner image;

a storage portion configured to store toner;

a replenishment unit to which a replenishment container storing the toner is detachably attachable, the replenishment unit being configured to transition between a replenishable state and a replenishing disabled state, the replenishable state being a state where it is possible to replenish the toner from the replenishment container to the storage portion, the replenishing disabled state being a state where it is not possible to replenish the toner from the replenishment container to the storage portion;

an agitation member configured to agitate the toner in the storage portion;

a drive source configured to drive the agitation member;

a control unit configured to control the drive source so as to drive the agitation member based on a transition of the replenishment unit to the replenishable state in a state where driving by the drive source is allowed;

a memory unit configured to store information on the transition of the replenishment unit to the replenishable state in a state where the driving by the drive source is not allowed; and a remaining amount detection unit configured to change an output value based on an amount of the toner in the storage portion, wherein, in a case where an initial control for bringing the image forming apparatus to a state capable of image formation is performed in a state where the information is stored in the memory unit, the control unit performs:

(1) a first operation to control the drive source to drive for a first time period in a case where it is judged, based on the output value of the remaining amount detection unit, that the amount of the toner in the storage portion has increased, and (2) a second operation to control the drive source to drive for a second time period that is shorter than the first time period in a case where it is judged, based on the output value of the remaining amount detection unit, that the amount of the toner in the storage portion has not increased.

2. The image forming apparatus according to claim 1, further comprising a conveyance unit configured to convey a sheet, wherein the drive source is configured to drive the agitation member and the conveyance unit.

3. The image forming apparatus according to claim 1, wherein the first time period becomes longer as an amount of the toner, detected by the remaining amount detection unit, in the storage portion increases.

4. The image forming apparatus according to claim 1, wherein the first time period is constant regardless of an increased amount of the toner, detected by the remaining amount detection unit, in the storage portion.

5. The image forming apparatus according to claim 1, wherein the control unit is configured to control the drive source not to drive when the initial control is performed in a state where the information is not stored in the memory unit and where a cleaning of the image bearing member is not requested.

6. The image forming apparatus according to claim 1, wherein the control unit is configured to perform a third operation to control the drive source so as to drive the agitation member for a third time period that is shorter than the first time period when the initial control is performed in a state where the information is not stored in the memory unit and where a cleaning of the image bearing member is not requested.

7. The image forming apparatus according to claim 6, wherein the third time period is shorter than the second time period.

8. The image forming apparatus according to claim 1, wherein the initial control is performed based on supply of electric power to the image forming apparatus.

9. The image forming apparatus according to claim 1, wherein the memory unit is configured to store the information in a case where electric power is supplied to the image forming apparatus.

10. The image forming apparatus according to claim 1, wherein the memory unit is configured to delete the information based on a transition of the replenishment unit from the replenishable state to the replenishing disabled state in a state where electric power is supplied to the image forming apparatus.

11. The image forming apparatus according to claim 1, wherein the replenishment container includes a first opening through which the toner is discharged, and wherein the replenishment unit includes a second opening and a lever portion, the second opening being an opening through which the toner discharged to the storage portion through the first opening passes, the lever portion, in a first position, being configured not to allow communication between the first opening and the second opening and, in a second position, being configured to allow communication between the first opening and the second opening, the replenishment unit being in the replenishing disabled state in a case where the lever portion is located in the first position, and the replenishment unit being in the replenishable state in a case where the lever portion is located in the second position.

12. The image forming apparatus according to claim 11, further comprising a sensor configured to change an output value based on a position of the lever portion.

13. The image forming apparatus according to claim 1, wherein the drive source is not allowed to drive in a case where a jam occurs in the image forming apparatus.

* * * * *